US006521297B2

(12) United States Patent
McDougall et al.

(10) Patent No.: US 6,521,297 B2
(45) **Date of Patent: *Feb. 18, 2003**

(54) MARKING MATERIAL AND BALLISTIC AEROSOL MARKING PROCESS FOR THE USE THEREOF

(75) Inventors: Maria N. V. McDougall, Burlington (CA); Richard P. N. Veregin, Mississauga (CA); Karen A. Moffat, Brantford (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/863,032

(22) Filed: May 22, 2001

(65) Prior Publication Data

US 2002/0012752 A1 Jan. 31, 2002

Related U.S. Application Data

(62) Division of application No. 09/585,044, filed on Jun. 1, 2000, now abandoned.

(51) Int. Cl.[7] ..... B41J 2/15

(52) U.S. Cl. ..... 427/421; 427/422; 347/20

(58) Field of Search ..... 347/20, 21, 25, 347/46, 43, 54, 65, 67; 427/288, 421, 422, 427

(56) References Cited

U.S. PATENT DOCUMENTS

| | | | | |
|---|---|---|---|---|
| 4,372,773 A | * | 2/1983 | Halasz | 65/108 |
| 5,278,020 A | | 1/1994 | Grushkin et al. | 430/137 |
| 5,290,654 A | | 3/1994 | Sacripante et al. | 430/137 |
| 5,308,734 A | | 5/1994 | Sacripante et al. | 430/137 |
| 5,344,738 A | | 9/1994 | Kmiecik-Lawrynowicz et al. | 430/137 |

(List continued on next page.)

FOREIGN PATENT DOCUMENTS

| | | |
|---|---|---|
| CA | 2143236 | 9/1995 |

OTHER PUBLICATIONS

Gotoh, et al., "Powder Technology Handbook", Marcel–Dekker, Inc., pp 8–11 (1997).

Diamond, "Handbook of Imaging Materials", Marcel–Dekker, Inc., p 178.

*Primary Examiner*—Michael Barr
*Assistant Examiner*—Eric B Fuller
(74) *Attorney, Agent, or Firm*—Judith L. Byorick

(57) ABSTRACT

Disclosed is a marking material comprising (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles. Also disclosed is a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles.

18 Claims, 8 Drawing Sheets

U.S. PATENT DOCUMENTS 5,346,797 A * 9/1994 Kmiecik-Lawrynowicz et al. ..... 430/137
5,348,832 A 9/1994 Sacripante et al. ..... 430/109
5,364,729 A 11/1994 Kmiecik-Lawrynowicz et al. ..... 430/137
5,366,841 A 11/1994 Patel et al. ..... 430/137
5,370,963 A 12/1994 Patel et al. ..... 430/137
5,376,172 A 12/1994 Tripp et al. ..... 106/490
5,403,693 A 4/1995 Patel et al. ..... 430/137
5,405,728 A 4/1995 Hopper et al. ..... 430/137
5,418,108 A 5/1995 Kmiecik-Lawrynowicz et al. ..... 430/137
5,496,676 A 3/1996 Croucher et al. ..... 430/137
5,501,935 A 3/1996 Patel et al. ..... 430/137
5,527,658 A 6/1996 Hopper et al. ..... 430/137
5,585,215 A 12/1996 Ong et al. ..... 430/107
5,650,255 A 7/1997 Ng et al. ..... 430/137
5,650,256 A 7/1997 Veregin et al. ..... 430/137
5,885,743 A 3/1999 Takayanagi et al. ..... 430/110
5,994,019 A * 11/1999 Okado et al. ..... 430/126
6,056,863 A * 5/2000 Gyota et al. ..... 205/118
6,116,718 A * 11/2000 Peeters et al. ..... 347/21
6,221,138 B1 * 4/2001 Kenny ..... 106/31.32
6,302,513 B1 * 10/2001 Moffat et al. ..... 347/20

* cited by examiner

MARKING MATERIAL AND BALLISTIC AEROSOL MARKING PROCESS FOR THE USE THEREOF

This application is a divisional of U.S. application Ser. No. 09/585,044, filed Jun. 1, 2000 now abandoned.

BACKGROUND OF THE INVENTION

The present invention is directed to an imaging process. More specifically, the present invention is directed to a ballistic aerosol marking process using specific marking materials. One embodiment of the present invention is directed to a marking material comprising (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles. Another embodiment of the present invention is directed to a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles.

Ink jet is currently a common printing technology. There are a variety of types of ink jet printing, including thermal ink jet printing, piezoelectric ink jet printing, and the like. In ink jet printing processes, liquid ink droplets are ejected from an orifice located at one terminus of a channel. In a thermal ink jet printer, for example, a droplet is ejected by the explosive formation of a vapor bubble within an ink bearing channel. The vapor bubble is formed by means of a heater, in the form of a resistor, located on one surface of the channel.

Several disadvantages can be associated with known ink jet systems. For a 300 spot-per-inch (spi) thermal ink jet system, the exit orifice from which an ink droplet is ejected is typically on the order of about 64 microns in width, with a channel-to-channel spacing (pitch) of typically about 84 microns; for a 600 dpi system, width is typically about 35 microns and pitch is typically about 42 microns. A limit on the size of the exit orifice is imposed by the viscosity of the fluid ink used by these systems. It is possible to lower the viscosity of the ink by diluting it with increasing amounts of liquid (such as water) with an aim to reducing the exit orifice width. The increased liquid content of the ink, however, results in increased wicking, paper wrinkle, and slower drying time of the ejected ink droplet, which negatively affects resolution, image quality (such as minimum spot size, intercolor mixing, spot shape), and the like. The effect of this orifice width limitation is to limit resolution of thermal ink jet printing, for example to well below 900 spi, because spot size is a function of the width of the exit orifice, and resolution is a function of spot size.

Another disadvantage of known ink jet technologies is the difficulty of producing grayscale printing. It is very difficult for an ink jet system to produce varying size spots on a printed substrate. If one lowers the propulsive force (heat in a thermal ink jet system) so as to eject less ink in an attempt to produce a smaller dot, or likewise increases the propulsive force to eject more ink and thereby to produce a larger dot, the trajectory of the ejected droplet is affected. The altered trajectory in turn renders precise dot placement difficult or impossible, and not only makes monochrome grayscale printing problematic, it makes multiple color grayscale ink jet printing impracticable. In addition, preferred grayscale printing is obtained not by varying the dot size, as is the case for thermal ink jet, but by varying the dot density while keeping a constant dot size.

Still another disadvantage of common ink jet systems is rate of marking obtained. Approximately 80 percent of the time required to print a spot is taken by waiting for the ink jet channel to refill with ink by capillary action. To a certain degree, a more dilute ink flows faster, but raises the problem of wicking, substrate wrinkle, drying time, and the like, discussed above.

One problem common to ejection printing systems is that the channels may become clogged. Systems such as thermal ink jet which employ aqueous ink colorants are often sensitive to this problem, and routinely employ non-printing cycles for channel cleaning during operation. This cleaning is required, since ink typically sits in an ejector waiting to be ejected during operation, and while sitting may begin to dry and lead to clogging.

Ballistic aerosol marking processes overcome many of these disadvantages. Ballistic aerosol marking is a process for applying a marking material to a substrate, directly or indirectly. In particular, the ballistic aerosol marking system includes a propellant which travels through a channel, and a marking material that is controllably (i.e., modifiable in use) introduced, or metered, into the channel such that energy from the propellant propels the marking material to the substrate. The propellant is usually a dry gas that can continuously flow through the channel while the marking apparatus is in an operative configuration (i.e., in a power-on or similar state ready to mark). Examples of suitable propellants include carbon dioxide gas, nitrogen gas, clean dry ambient air, gaseous products of a chemical reaction, or the like; preferably, non-toxic propellants are employed, although in certain embodiments, such as devices enclosed in a special chamber or the like, a broader range of propellants can be tolerated. The system is referred to as "ballistic aerosol marking" in the sense that marking is achieved by in essence launching a non-colloidal, solid or semi-solid particulate, or alternatively a liquid, marking material at a substrate. The shape of the channel can result in a collimated (or focused) flight of the propellant and marking material onto the substrate.

The propellant can be introduced at a propellant port into the channel to form a propellant stream. A marking material can then be introduced into the propellant stream from one or more marking material inlet ports. The propellant can enter the channel at a high velocity. Alternatively, the propellant can be introduced into the channel at a high pressure, and the channel can include a constriction (for example, de Laval or similar converging/diverging type nozzle) for converting the high pressure of the propellant to high velocity. In such a situation, the propellant is introduced at a port located at a proximal end of the channel (the converging region), and the marking material ports are provided near the distal end of the channel (at or further down-stream of the diverging region), allowing for introduction of marking material into the propellant stream.

In the situation where multiple ports are provided, each port can provide for a different color (for example, cyan, magenta, yellow, and black), pre-marking treatment material (such as a marking material adherent), post-marking treatment material (such as a substrate surface finish material, for example, matte or gloss coating, or the like), marking material not otherwise visible to the unaided eye (for example, magnetic particle-bearing material, ultraviolet-fluorescent material, or the like) or other marking material to be applied to the substrate. Examples of materials suitable for pre-marking treatment and post-marking treatment include polyester resins (either linear or branched); poly (styrenic) homopolymers; poly(acrylate) and poly (methacrylate) homopolymers and mixtures thereof; random copolymers of styrenic monomers with acrylate, methacrylate, or butadiene monomers and mixtures thereof; polyvinyl acetals; poly(vinyl alcohol)s; vinyl alcohol-vinyl acetal copolymers; polycarbonates; mixtures thereof; and the like. The marking material is imparted with kinetic energy from the propellant stream, and ejected from the channel at an exit orifice located at the distal end of the channel in a direction toward a substrate.

One or more such channels can be provided in a structure which, in one embodiment, is referred to herein as a printhead. The width of the exit (or ejection) orifice of a channel is typically on the order of about 250 microns or smaller, and preferably in the range of about 100 microns or smaller. When more than one channel is provided, the pitch, or spacing from edge to edge (or center to center) between adjacent channels can also be on the order of about 250 microns or smaller, and preferably in the range of about 100 microns or smaller. Alternatively, the channels can be staggered, allowing reduced edge-to-edge spacing. The exit orifice and/or some or all of each channel can have a circular, semicircular, oval, square, rectangular, triangular or other cross-sectional shape when viewed along the direction of flow of the propellant stream (the channel's longitudinal axis).

The marking material to be applied to the substrate can be transported to a port by one or more of a wide variety of ways, including simple gravity feed, hydrodynamic, electrostatic, ultrasonic transport, or the like. The material can be metered out of the port into the propellant stream also by one of a wide variety of ways, including control of the transport mechanism, or a separate system such as pressure balancing, electrostatics, acoustic energy, ink jet, or the like.

The marking material to be applied to the substrate can be a solid or semi-solid particulate material, such as a toner or variety of toners in different colors, a suspension of such a marking material in a carrier, a suspension of such a marking material in a carrier with a charge director, a phase change material, or the like. Preferably the marking material is particulate, solid or semi-solid, and dry or suspended in a liquid carrier. Such a marking material is referred to herein as a particulate marking material. A particulate marking material is to be distinguished from a liquid marking material, dissolved marking material, atomized marking material, or similar non-particulate material, which is generally referred to herein as a liquid marking material. However, ballistic aerosol marking processes are also able to utilize such a liquid marking material in certain applications.

Ballistic aerosol marking processes also enable marking on a wide variety of substrates, including direct marking on non-porous substrates such as polymers, plastics, metals, glass, treated and finished surfaces, and the like. The reduction in wicking and elimination of drying time also provides improved printing to porous substrates such as paper, textiles, ceramics, and the like. In addition, ballistic aerosol marking processes can be configured for indirect marking, such as marking to an intermediate transfer roller or belt, marking to a viscous binder film and nip transfer system, or the like.

The marking material to be deposited on a substrate can be subjected to post ejection modification, such as fusing or drying, overcoating, curing, or the like. In the case of fusing, the kinetic energy of the material to be deposited can itself be sufficient effectively to melt the marking material upon impact with the substrate and fuse it to the substrate. The substrate can be heated to enhance this process. Pressure rollers can be used to cold-fuse the marking material to the substrate. In-flight phase change (solid-liquid-solid) can alternatively be employed. A heated wire in the particle path is one way to accomplish the initial phase change. Alternatively, propellant temperature can accomplish this result. In one embodiment, a laser can be employed to heat and melt the particulate material in-flight to accomplish the initial phase change. The melting and fusing can also be electrostatically assisted (i.e., retaining the particulate material in a desired position to allow ample time for melting and fusing into a final desired position). The type of particulate can also dictate the post-ejection modification. For example, ultraviolet curable materials can be cured by application of ultraviolet radiation, either in flight or when located on the material-bearing substrate.

Since propellant can continuously flow through a channel, channel clogging from the build-up of material is reduced (the propellant effectively continuously cleans the channel). In addition, a closure can be provided that isolates the channels from the environment when the system is not in use. Alternatively, the printhead and substrate support (for example, a platen) can be brought into physical contact to effect a closure of the channel. Initial and terminal cleaning cycles can be designed into operation of the printing system to optimize the cleaning of the channel(s). Waste material cleaned from the system can be deposited in a cleaning station. It is also possible, however, to engage the closure against an orifice to redirect the propellant stream through the port and into the reservoir thereby to flush out the port.

Further details on the ballistic aerosol marking process are disclosed in, for example, Copending application U.S. Ser. No. 09/163,893, filed Sep. 30, 1998, with the named inventors Gregory B. Anderson, Steven B. Bolte, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Ballistic Aerosol Marking Apparatus for Marking a Substrate," Copending application U.S. Ser. No. 09/164,124, filed Sep. 30, 1998, with the named inventors Gregory B. Anderson, Steven B. Bolte, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Method of Marking a Substrate Employing a Ballistic Aerosol Marking Apparatus," Copending application U.S. Ser. No. 09/164,250, filed Sep. 30, 1998, with the named inventors Gregory B. Anderson, Danielle C. Boils, Steven B. Bolte, Dan A. Hays, Warren B. Jackson, Gregory J. Kovacs, Meng H. Lean, T. Brian McAneney, Maria N. V. McDougall, Karen A. Moffat, Jaan Noolandi, Richard P. N. Veregin, Paul D. Szabo, Joel A. Kubby, Eric Peeters, Raj B. Apte, Philip D. Floyd, An-Chang Shi, Frederick J. Endicott, Armin R. Volkel, and Jonathan A. Small, entitled "Ballistic Aerosol Marking Apparatus for Treating a Substrate," Copending application U.S. Ser. No, 09/163,808, filed Sep. 30, 1998, with the named inventors Gregory B. Anderson, Danielle C. Boils, Steven B. Bolte, Dan A. Hays, Warren B. Jackson, Gregory J. Kovacs, Meng H. Lean, T. Brian McAneney, Maria N. V. McDougall, Karen A. Moffat, Jaan Noolandi, Richard P. N. Veregin, Paul D. Szabo, Joel A. Kubby, Eric Peeters, Raj B. Apte, Philip D. Floyd, An-Chang Shi, Frederick J. Endicott, Armin R. Volkel, and Jonathan A. Small, entitled "Method of Treating a Substrate Employing a Ballistic Aerosol Marking Apparatus," Copending application U.S. Ser. No. 09/163,765, filed Sep. 30, 1998, with the named inventors Gregory B. Anderson, Steven B. Bolte, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Cartridge for Use in a Ballistic Aerosol Marking Apparatus," Copending application U.S. Ser. No. 09/163,839, filed Sep. 30, 1998, with the named inventors Abdul M. Elhatem, Dan A. Hays, Jaan Noolandi, Kaiser H. Wong, Joel A. Kubby, Tuan Anh Vo, and Eric Peeters, entitled "Marking Material Transport," Copending application U.S. Ser. No. 09/163,954, filed Sep. 30, 1998, with the named inventors Gregory B. Anderson, Andrew A. Berlin, Steven B. Bolte, Ga Neville Connell, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Ballistic Aerosol Marking Apparatus for Marking with a Liquid Material," Copending application U.S. Ser. No. 09/163,924, filed Sep. 30, 1998, with the named inventors Gregory B. Anderson, Andrew A. Berlin, Steven B. Bolte, Ga Neville Connell, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Method for Marking with a Liquid Material Using a Ballistic Aerosol Marking Apparatus," Copending application U.S. Ser. No. 09/163,825, filed Sep. 30, 1998, with the named inventor Kaiser H. Wong, entitled "Multi-Layer Organic Overcoat for Electrode Grid," Copending application U.S. Ser. No. 09/164,104, filed Sep. 30, 1998, with the named inventors T. Brian McAneney, Jaan Noolandi, and An-Chang Shi, entitled "Kinetic Fusing of a Marking Material," Copending application U.S. Ser. No. 09/163,904, filed Sep. 30, 1998, with the named inventors Meng H. Lean, Jaan Noolandi, Eric Peeters, Raj B. Apte, Philip D. Floyd, and Armin R. Volkel, entitled "Print Head for Use in a Ballistic Aerosol Marking Apparatus," Copending application U.S. Ser. No. 09/163,799, filed Sep. 30, 1998, with the named inventors Meng H. Lean, Jaan Noolandi, Eric Peeters, Raj B. Apte, Philip D. Floyd, and Armin R. Volkel, entitled "Method of Making a Print Head for Use in a Ballistic Aerosol Marking Apparatus," Copending application U.S. Ser. No. 09/163,664, filed Sep. 30, 1998, with the named inventors Bing R. Hsieh, Kaiser H. Wong, and Tuan Anh Vo, entitled "Organic Overcoat for Electrode Grid," and Copending application U.S. Ser. No. 09/163,518, filed Sep. 30, 1998, with the named inventors Kaiser H. Wong and Tuan Anh Vo, entitled "Inorganic Overcoat for Particulate Transport Electrode Grid", the disclosures of each of which are totally incorporated herein by reference.

Copending application U.S. Ser. No. 09/408,606, filed Sep. 30, 1999, entitled "Marking Materials and Marking Processes Therewith," with the named inventors Richard P. Veregin, Carl P. Tripp, Maria N. McDougall, and T. Brian McAneney, the disclosure of which is totally incorporated herein by reference, discloses an apparatus for depositing a particulate marking material onto a substrate, comprising (a) a printhead having defined therein at least one channel, each channel having an inner surface and an exit orifice with a width no larger than about 250 microns, the inner surface of each channel having thereon a hydrophobic coating material; (b) a propellant source connected to each channel such that propellant provided by the propellant source can flow through each channel to form propellant streams therein, said propellant streams having kinetic energy, each channel directing the propellant stream through the exit orifice toward the substrate; and (c) a marking material reservoir having an inner surface, said inner surface having thereon the hydrophobic coating material, said reservoir containing particles of a particulate marking material, said reservoir being communicatively connected to each channel such that the particulate marking material from the reservoir can be controllably introduced into the propellant stream in each channel so that the kinetic energy of the propellant stream can cause the particulate marking material to impact the substrate, wherein either (i) the marking material particles of particulate marking material have an outer coating of the hydrophobic coating material, or (ii) the marking material particles have additive particles on the surface thereof, said additive particles having an outer coating of the hydrophobic coating material; or (iii) both the marking material particles and the additive particles have an outer coating of the hydrophobic coating material.

Copending application U.S. Ser. No. 09/410,271, filed Sep. 30, 1999, entitled "Marking Materials and Marking Processes Therewith," with the named inventors Karen A. Moffat, Richard P. Veregin, Maria N. McDougall, Philip D. Floyd, Jaan Noolandi, T. Brian McAneney, and Daniele C. Boils-Boissier, the disclosure of which is totally incorporated herein by reference, discloses a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises particles which comprise a resin and a colorant, said particles having an average particle diameter of no more than about 7 microns and a particle size distribution of GSD equal to no more than about 1.25, wherein said particles are prepared by an emulsion aggregation process.

While known compositions and processes are suitable for their intended purposes, a need remains for improved marking processes. In addition, a need remains for improved ballistic aerosol marking materials and processes. Further, a need remains for ballistic aerosol marking materials and processes that enable the printing of very small pixels, enabling printing resolutions of 900 dots per inch or more.

Additionally, there is a need for ballistic aerosol marking materials and processes in which the possibility of the marking material clogging the printing channels is reduced. There is also a need for ballistic aerosol marking processes wherein the marking material does not become undesirably charged. In addition, there is a need for ballistic aerosol marking processes wherein the marking material exhibits desirable flow properties. Further, there is a need for ballistic aerosol marking processes wherein the marking material contains particles of desirably small particle size and desirably narrow particle size distribution. Additionally, there is a need for ballistic aerosol marking processes wherein the marking material can obtain a low degree of surface charge without becoming so highly charged that the material becomes agglomerated or causes channel clogging. A need also remains for ballistic aerosol marking processes wherein the marking material is semi-conductive or conductive (as opposed to insulative) and capable of retaining electrostatic charge. In addition, a need remains for ballistic aerosol marking processes wherein the marking materials have sufficient conductivity to provide for inductive charging to enable toner transport and gating into the printing channels. Further, a need remains for ballistic aerosol marking processes wherein the marking materials can be selected to control the level of electrostatic charging and conductivity, thereby preventing charge build up in the BAM subsystems, controlling relative humidity, and maintaining excellent flow.

SUMMARY OF THE INVENTION

The present invention is directed to a marking material comprising (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles. Another embodiment of the present invention is directed to a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles.

DETAILED DESCRIPTION OF THE INVENTION

In the following detailed description, numeric ranges are provided for various aspects of the embodiments described, such as pressures, velocities, widths, lengths, and the like. These recited ranges are to be treated as examples only, and are not intended to limit the scope of the claims hereof. In addition, a number of materials are identified as suitable for various aspects of the embodiments, such as for marking materials, propellants, body structures, and the like. These recited materials are also to be treated as exemplary, and are not intended to limit the scope of the claims hereof.

Figure 1:
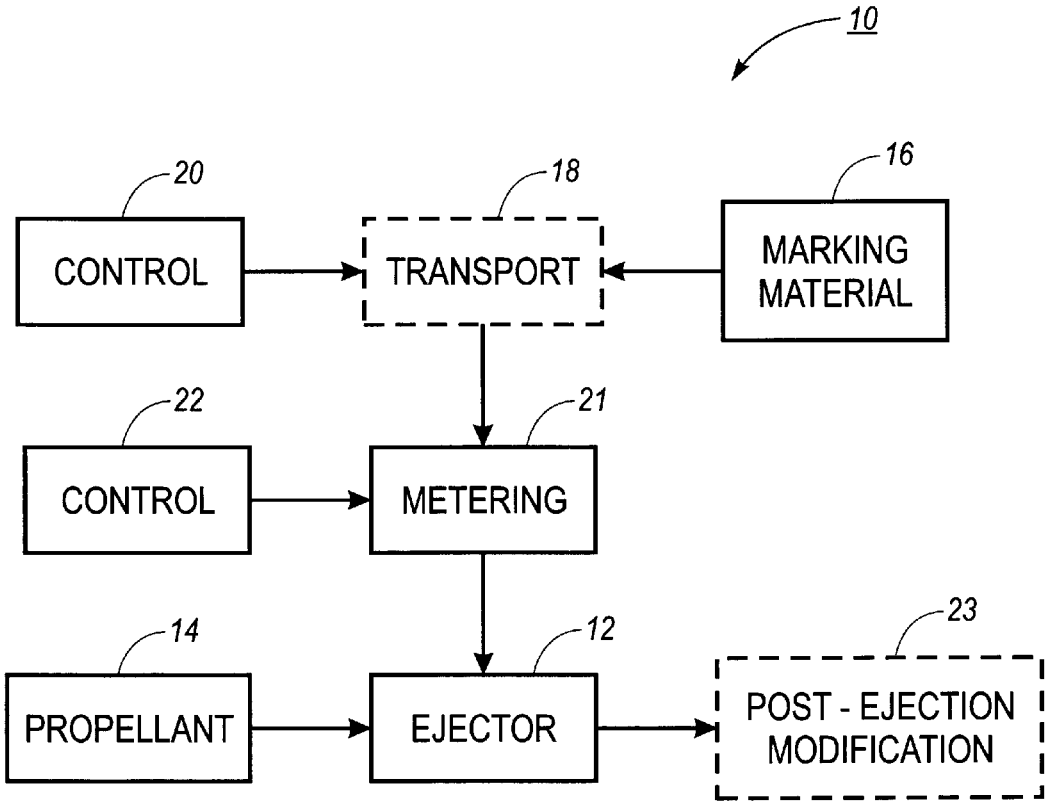
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 comprises one or more ejectors 12 to which a propellant 14 is fed. A marking material 16, which can be transported by a transport 18 under the control of control 20, is introduced into ejector 12. (Optional elements are indicated by dashed lines.) The marking material is metered (that is controllably introduced) into the ejector by metering device 21, under control of control 22. The marking material ejected by ejector 12 can be subject to post ejection modification 23, optionally also part of device 10. Each of these elements will be described in further detail below. It will be appreciated that device 10 can form a part of a printer, for example of the type commonly attached to a computer network, personal computer or the like, part of a facsimile machine, part of a document duplicator, part of a labelling apparatus, or part of any other of a wide variety of marking devices.

Figure 2:
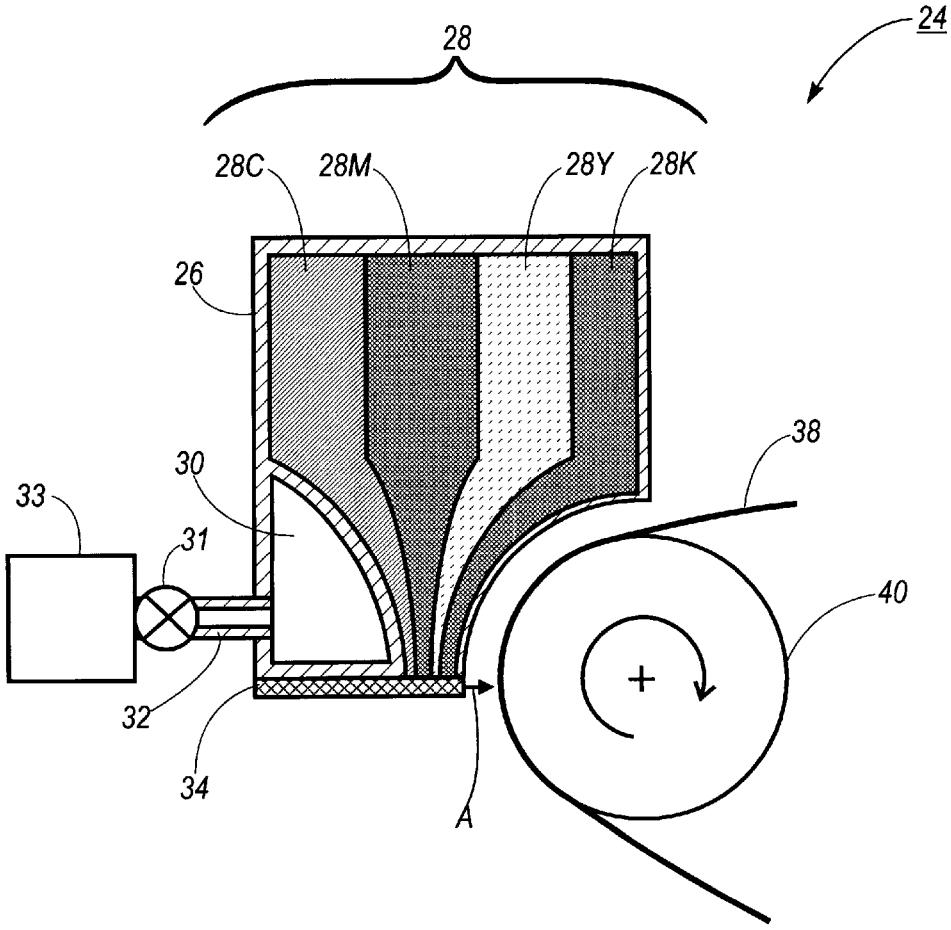
FIG. 2 is cross sectional illustration of a marking apparatus according to one embodiment of the present invention.

The embodiment illustrated in FIG. 1 can be realized by a ballistic aerosol marking device 24 of the type shown in the cut-away side view of FIG. 2. According to this embodiment, the materials to be deposited will be four colored marking materials, for example cyan (C), magenta (M), yellow (Y), and black (K), of a type described further herein, which can be deposited concomitantly, either mixed or unmixed, successively, or otherwise. While the illustration of FIG. 2 and the associated description contemplates a device for marking with four colors (either one color at a time or in mixtures thereof), a device for marking with a fewer or a greater number of colors, or other or additional materials, such as materials creating a surface for adhering marking material particles (or other substrate surface pretreatment), a desired substrate finish quality (such as a matte, satin or gloss finish or other substrate surface post-treatment), material not visible to the unaided eye (such as magnetic particles, ultra violet-fluorescent particles, and the like) or other material associated with a marked substrate, is clearly contemplated herein.

Device 24 comprises a body 26 within which is formed a plurality of cavities 28C, 28M, 28Y, and 28K (collectively referred to as cavities 28) for receiving materials to be deposited. Also formed in body 26 can be a propellant cavity 30. A fitting 32 can be provided for connecting propellant cavity 30 to a propellant source 33 such as a compressor, a propellant reservoir, or the like. Body 26 can be connected to a print head 34, comprising, among other layers, substrate 36 and channel layer 37.

Figure 3:
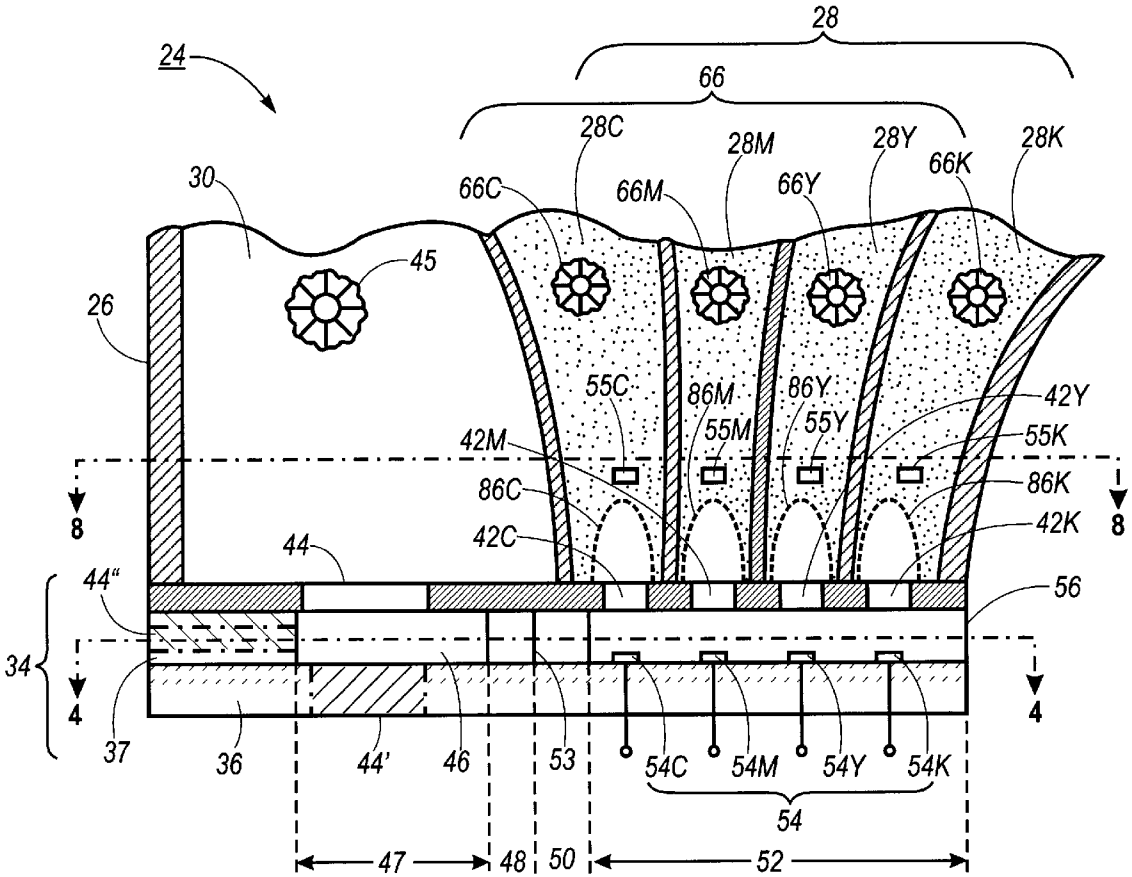
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively, of circular, oval, rectangular, or other cross-section, providing communication between said cavities, and a channel 46 which adjoins body 26. Ports 42 are shown having a longitudinal axis roughly perpendicular to the longitudinal axis of channel 46. The angle between the longitudinal axes of ports 42 and channel 46, however, can be other than 90 degrees, as appropriate for the particular application of the present invention.

Likewise, propellant cavity 30 includes a port 44, of circular, oval, rectangular, or other cross-section, between said cavity and channel 46 through which propellant can travel. Alternatively, print head 34 can be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. It has been demonstrated that a propellant marking material flow pattern from a print head employing a number of the features described herein can remain relatively collimated for a distance of up to 10 millimeters, with an optimal printing spacing on the order of between one and several millimeters. For example, the print head can produce a marking material stream which does not deviate by more than about 20 percent, and preferably by not more than about 10 percent, from the width of the exit orifice for a distance of at least 4 times the exit orifice width. The appropriate spacing between the print head and the substrate, however, is a function of many parameters, and does not itself form a part of the present invention. In one preferred embodiment, the kinetic energy of the particles, which are moving at very high velocities toward the substrate, is converted to thermal energy upon impact of the particles on the substrate, thereby fixing or fusing the particles to the substrate. In this embodiment, the glass transition temperature of the resin in the particles is selected so that the thermal energy generated by impact with the substrate is sufficient to fuse the particles to the substrate; this process is called kinetic fusing.

According to one embodiment of the present invention, print head 34 comprises a substrate 36 and channel layer 37 in which is formed channel 46. Additional layers, such as an insulating layer, capping layer, or the like (not shown) can also form a part of print head 34. Substrate 36 is formed of a suitable material such as glass, ceramic, or the like, on which (directly or indirectly) is formed a relatively thick material, such as a thick permanent photoresist (for example, a liquid photosensitive epoxy such as SU-8, commercially available from Microlithography Chemicals, Inc.; see also U.S. Pat. No. 4,882,245, the disclosure of which is totally incorporated herein by reference) and/or a dry film-based photoresist such as the Riston photopolymer resist series, commercially available from DuPont Printed Circuit Materials, Research Triangle Park, N.C. which can be etched, machined, or otherwise in which can be formed a channel with features described below.

Figure 4:
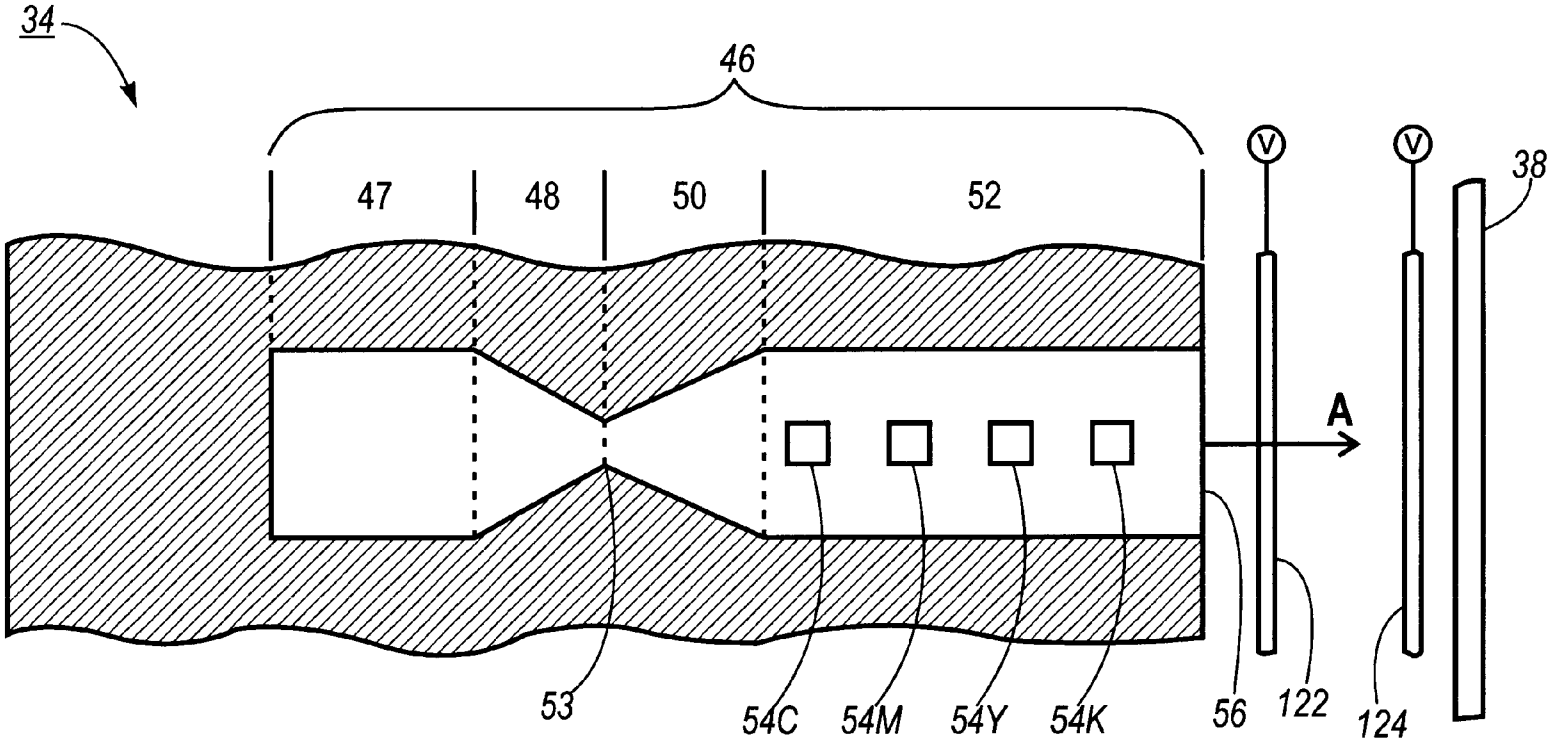
FIG. 4 is a plan view of one channel, with nozzle, of the marking apparatus shown in FIG. 3.

Referring now to FIG. 4, which is a cut-away plan view of print head 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe or a venturi convergence/divergence structure. An exit orifice 56 is located at the distal end of channel 46.

Figure 5A:
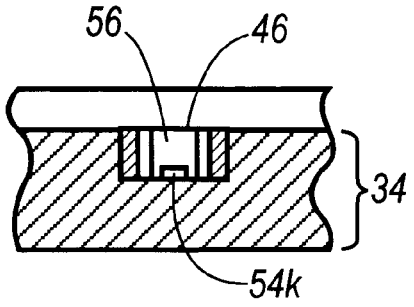
FIGS. 5A through 5C and 6A through 6C are cross sectional views, in the longitudinal direction, of several examples of channels according to the present invention.
Figure 5B:
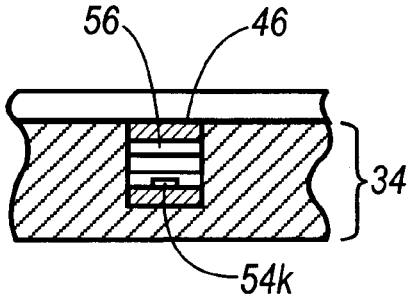
Figure 5C:
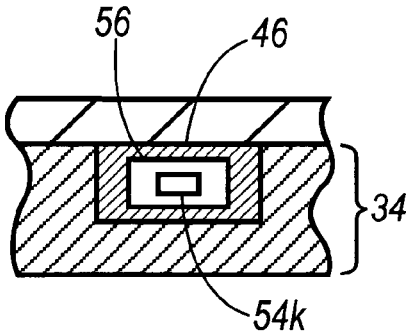
Figure 6A:
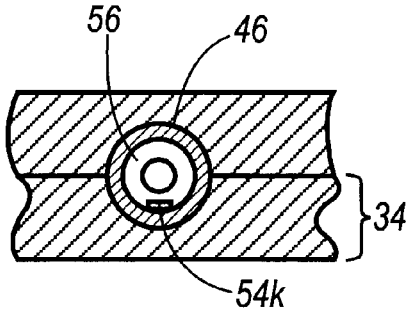
Figure 6B:
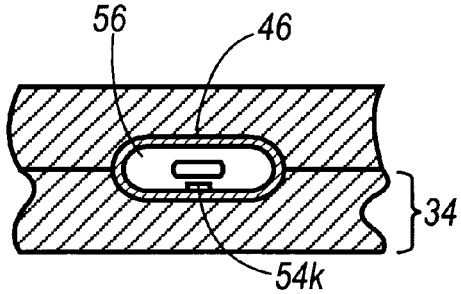
Figure 6C:
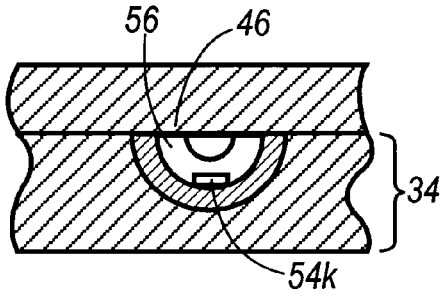

In the embodiment of the present invention shown in FIGS. 3 and 4, region 48 converges in the plane of FIG. 4, but not in the plane of FIG. 3, and likewise region 50 diverges in the plane of FIG. 4, but not in the plane of FIG. 3. Typically, this divergence determines the cross-sectional shape of the exit orifice 56. For example, the shape of orifice 56 illustrated in FIG. 5A corresponds to the device shown in FIGS. 3 and 4. However, the channel can be fabricated such that these regions converge/diverge in the plane of FIG. 3, but not in the plane of FIG. 4 (illustrated in FIG. 5B), or in both the planes of FIGS. 3 and 4 (illustrated in FIG. 5C), or in some other plane or set of planes, or in all planes (examples illustrated in FIGS. 6A–6C) as can be determined by the manufacture and application of the present invention.

Figure 7:
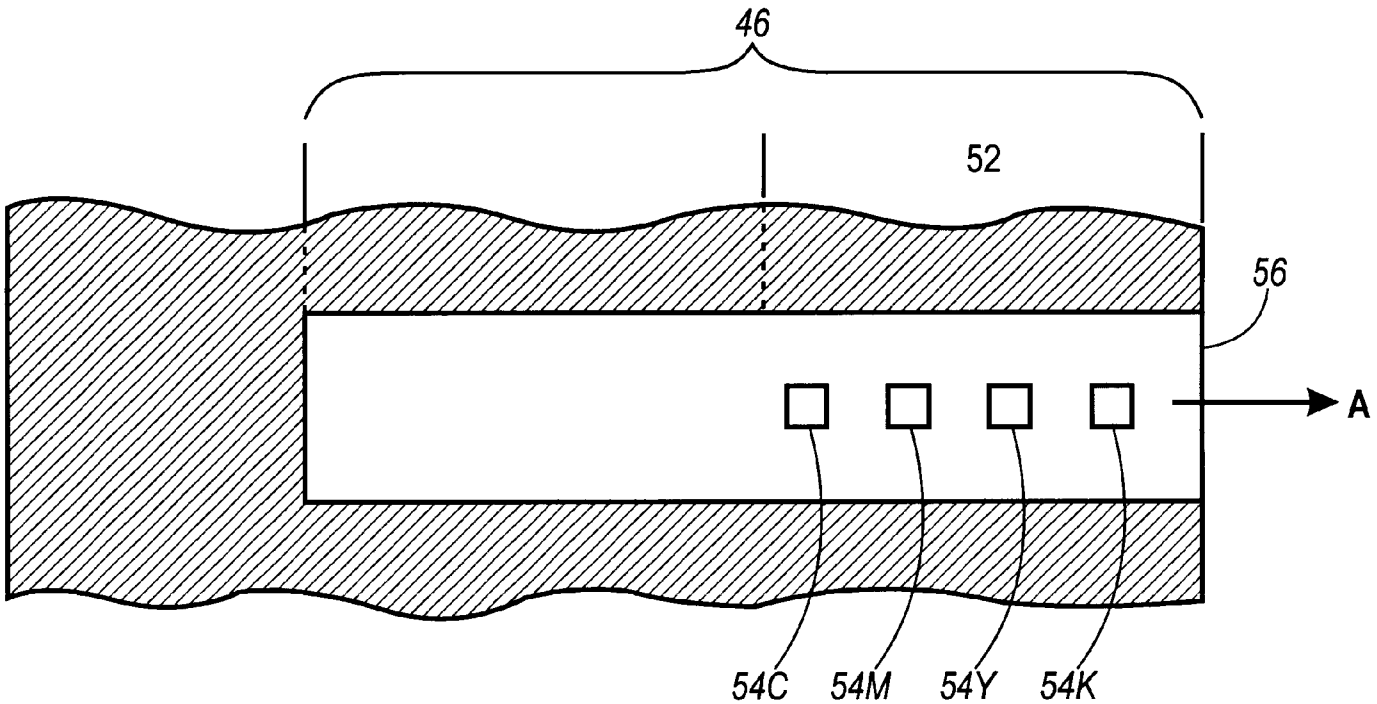
FIG. 7 is another plan view of one channel of a marking apparatus, without a nozzle, according to the present invention.
Figure 8A:
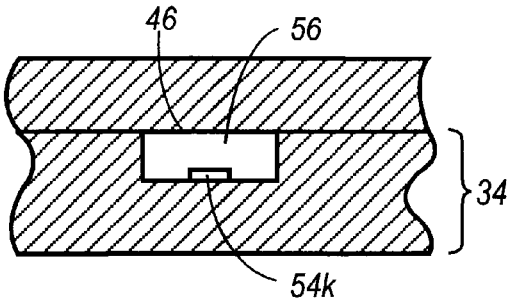
FIGS. 8A through 8D are cross sectional views, along the longitudinal axis, of several additional examples of channels according to the present invention.
Figure 8B:
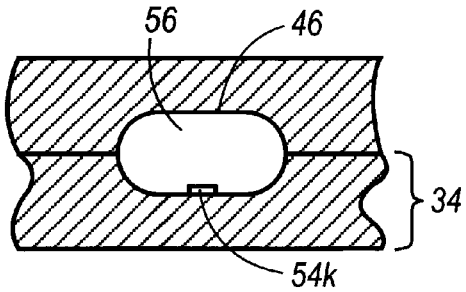
Figure 8C:
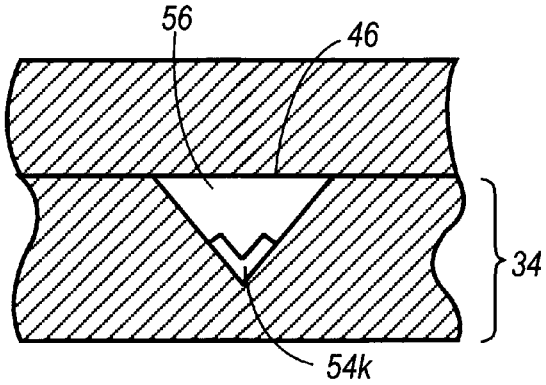
Figure 8D:
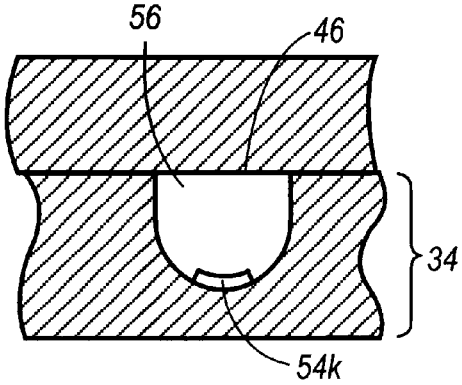

In another embodiment, shown in FIG. 7, channel 46 is not provided with a converging and diverging region, but rather has a uniform cross section along its axis. This cross section can be rectangular or square (illustrated in FIG. 8A), oval or circular (illustrated in FIG. 8B), or other cross section (examples are illustrated in FIGS. 8C–8D), as can be determined by the manufacture and application of the present invention.

Any of the aforementioned channel configurations or cross sections are suitable for the present invention. The de Laval or venturi configuration is, however, preferred because it minimizes spreading of the collimated stream of marking particles exiting the channel.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant can flow continuously through the channel while the marking apparatus is in an operative configuration (for example, a "power on" or similar state ready to mark), or can be modulated such that propellant passes through the channel only when marking material is to be ejected, as dictated by the particular application of the present invention. Such propellant modulation can be accomplished by a valve 31 interposed between the propellant source 33 and the channel 46, by modulating the generation of the propellant for example by turning on and off a compressor or selectively initiating a chemical reaction designed to generate propellant, or the like.

Marking material can controllably enter the channel through one or more ports 42 located in the marking material injection region 52. That is, during use, the amount of marking material introduced into the propellant stream can be controlled from zero to a maximum per spot. The propellant and marking material travel from the proximal end to a distal end of channel 46 at which is located exit orifice 56.

According to one embodiment for metering the marking material, the marking material includes material which can be imparted with an electrostatic charge. For example, the marking material can comprise a pigment suspended in a binder together with charge directors. The charge directors can be charged, for example by way of a corona 66C, 66M, 66Y, and 66K (collectively referred to as coronas 66), located in cavities 28, shown in FIG. 3. Another option is initially to charge the propellant gas, for example, by way of a corona 45 in cavity 30 (or some other appropriate location such as port 44 or the like.) The charged propellant can be made to enter into cavities 28 through ports 42, for the dual purposes of creating a fluidized bed 86C, 86M, 86Y, and 86K (collectively referred to as fluidized bed 86), and imparting a charge to the marking material. Other options include tribocharging, by other means external to cavities 28, or other mechanism.

Formed at one surface of channel 46, opposite each of the ports 42 are electrodes 54C, 54M, 54Y, and 54K (collectively referred to as electrodes 54). Formed within cavities 28 (or some other location such as at or within ports 44) are corresponding counter-electrodes 55C, 55M, 55Y, and 55K (collectively referred to as counter-electrodes 55). When an electric field is generated by electrodes 54 and counter-electrodes 55, the charged marking material can be attracted to the field, and exits cavities 28 through ports 42 in a direction roughly perpendicular to the propellant stream in channel 46. Alternatively, when an electric field is generated by electrodes 54 and counter-electrodes 55, a charge can be induced on the marking material, provided that the marking material has sufficient conductivity, and can be attracted to the field, and exits cavities 28 through ports 42 in a direction roughly perpendicular to the propellant stream in channel 46. In either embodiment, the shape and location of the electrodes and the charge applied thereto determine the strength of the electric field, and accordingly determine the force of the injection of the marking material into the propellant stream. In general, the force injecting the marking material into the propellant stream is chosen such that the momentum provided by the force of the propellant stream on the marking material overcomes the injecting force, and once into the propellant stream in channel 46, the marking material travels with the propellant stream out of exit orifice 56 in a direction towards the substrate.

In the event that fusing assistance is required (for example, when an elastic substrate is used, when the marking material particle velocity is low, or the like), a number of approaches can be employed. For example, one or more heated filaments 122 can be provided proximate the ejection port 56 (shown in FIG. 4), which either reduces the kinetic energy needed to melt the marking material particle or in fact at least partly melts the marking material particle in flight. Alternatively, or in addition to filament 122, a heated filament 124 can be located proximate substrate 38 (also shown in FIG. 4) to have a similar effect, While FIGS. 4 to 8 illustrate a print head 34 having one channel therein, it will be appreciated that a print head according to the present invention can have an arbitrary number of channels, and range from several hundred micrometers across with one or several channels, to a page-width (for example, 8.5 or more inches across) with thousands of channels. The width W of each exit orifice 56 can be on the order of 250 $\mu$m or smaller, preferably in the range of 100 $\mu$m or smaller. The pitch P, or spacing from edge to edge (or center to center) between adjacent exit orifices 56 can also be on the order of 250 $\mu$m or smaller, preferably in the range of 100 $\mu$m or smaller in non-staggered array. In a two-dimensionally staggered array, the pitch can be further reduced.

The marking materials of the present invention comprise toner particles having an average particle diameter of no more than about 7 microns, and preferably no more than about 6.5 microns, and a particle size distribution of GSD equal to no more than about 1.25, and preferably no more than about 1.23. The toner particles comprise a colorant well dispersed in a resin (for example, a random copolymer of a styrene/n-butyl acrylate/acrylic acid resin), hydrophobic conductive metal oxide particles on the surfaces of the toner particles, and optionally other external surface additives on the surfaces of the toner particles. The resin is selected so that the resin glass transition temperature is such as to enable kinetic fusing. If the velocity of the toner particles upon impact with the substrate is known, the value of the $T_g$ required to enable kinetic fusing can be calculated as follows:

The critical impact velocity $v_c$ required to melt the toner particle kinetically is estimated for a collision with an infinitely stiff substrate. The kinetic energy $E_k$ of a spherical particle with velocity v, density ρ, and diameter d is:

$$E_k = \frac{\pi \cdot \rho \cdot d^3 \cdot v^2}{12}$$

The energy $E_m$ required to heat a spherical particle with diameter d, heat capacity $C_p$, and density ρ from room temperature $T_0$ to beyond its glass transition temperature $T_g$ is:

$$E_m = \frac{\pi \cdot \rho \cdot d^3 \cdot C_p \cdot (T_g - T_0)}{6}$$

The energy $E_p$ required to deform a particle with diameter d and Young's modulus E beyond its elasticity limit $\sigma_e$ and into the plastic deformation regime is:

$$E_p = \frac{d^3 \cdot \sigma_e^2}{2E}$$

For kinetic fusing (melting the particle by plastic deformation from the collision with an infinitely stiff substrate), the kinetic energy of the incoming particle should be large enough to bring the particle beyond its elasticity limit. In addition, if the particle is taken beyond its elasticity limit, kinetic energy is transformed into heat through plastic deformation of the particle. If it is assumed that all kinetic energy is transformed into heat, the particle will melt if the kinetic energy ($E_k$) is larger than the heat required to bring the particle beyond its glass transition temperature ($E_m$). The critical velocity for obtaining plastic deformation ($v_{cp}$) can be calculated by equating $E_k$ to $E_p$:

$$v_{cp} = \sqrt{\frac{6}{\pi \rho E}} \cdot \sigma_e$$

Note that this expression is independent of particle size. Some numerical examples (Source: *CRC Handbook*) include:

| Material | E (Pa) | ρ (kg/m³) | $\sigma_e$(Pa) | $v_{cp}$ (m/s) |
|---|---|---|---|---|
| Steel | 200E9 | 8,000 | 700E6 | 25 |
| Polyethylene | 140E6 | 900 | 7E6 | 28 |
| Neoprene | 3E6 | 1,250 | 20E6 | 450 |
| Lead | 13E9 | 11,300 | 14E6 | 1.6 |

Most thermoplastic materials (such as polyethylene) require an impact velocity on the order of a few tens of meters per second to achieve plastic deformation from the collision with an infinitely stiff wall. Velocities on the order of several hundred of meters per second are achieved in ballistic aerosol marking processes. The critical velocity for kinetic melt ($v_{cm}$) can be calculated by equating $E_k$ to $E_m$:

$$V_{cm}=\sqrt{2.C_p.(T_{g-T_0})}$$

Note that this expression is independent of particle size and density. For example, for a thermoplastic material with $C_p$=1000 J/kg.K and $T_g$=60° C., $T_0$=20°C., the critical velocity $V_{cm}$ to achieve kinetic melt is equal to 280 meters per second, which is in the order of magnitude of the ballistic aerosol velocities (typically from about 300 to about 350 meters per second).

The marking materials of the present invention comprise toner particles comprising a resin and a colorant. Examples of suitable resins include poly(styrene/butadiene), poly(p-methyl styrene/butadiene), poly(m-methyl styrene/butadiene), poly(α-methyl styrene/butadiene), poly(methyl methacrylate/butadiene), poly(ethyl methacrylate/butadiene), poly(propyl methacrylate/butadiene), poly(butyl methacrylate/butadiene), poly(methyl acrylate/butadiene), poly(ethyl acrylate/butadiene), poly(propyl acrylate/butadiene), poly(butyl acrylate/butadiene), poly(styrene/isoprene), poly(p-methyl styrene/isoprene), poly(m-methyl styrene/isoprene), poly(α-methyl styrene/isoprene), poly(methyl methacrylate/isoprene), poly(ethyl methacrylate/isoprene), poly(propyl methacrylate/isoprene), poly(butyl methacrylate/isoprene), poly(methyl acrylate/isoprene), poly(ethyl acrylate/isoprene), poly(propyl acrylate/isoprene), poly(butylacrylate-isoprene), poly(styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), polyethylene terephthalate, polypropylene terephthalate, polybutylene terephthalate, polypentylene terephthalate, polyhexalene terephthalate, polyheptadene terephthalate, polyoctalene-terephthalate, sulfonated polyesters such as those disclosed in U.S. Pat. No. 5,348,832, and the like, as well as mixtures thereof. The resin is present in the toner particles in any desired or effective amount, typically at least about 75 percent by weight of the toner particles, and preferably at least about 85 percent by weight of the toner particles, and typically no more than about 99 percent by weight of the toner particles, and preferably no more than about 98 percent by weight of the toner particles, although the amount can be outside of these ranges.

Examples of suitable colorants include dyes and pigments, such as carbon black (for example, REGAL 330®), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E.I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido) phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK® and cyan components, and the like, as well as mixtures thereof. Other commercial sources of pigments available as aqueous pigment dispersion from either Sun Chemical or Ciba include (but are not limited to) Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Mixtures of colorants can also be employed. The colorant is present in the toner particles in any desired or effective amount, typically at least about 1 percent by weight of the toner particles, and preferably at least about 2 percent by weight of the toner particles, and typically no more than about 25 percent by weight of the toner particles, and preferably no more than about 15 percent by weight of the toner particles, depending on the desired particle size, although the amount can be outside of these ranges.

The toner particles optionally can also contain charge control additives, such as alkyl pyridinium halides, bisulfates, the charge control additives disclosed in U.S. Pat. Nos. 3,944,493, 4,007,293, 4,079,014, 4,394,430, and 4,560,635, the disclosures of each of which are totally incorporated herein by reference, and the like, as well as mixtures thereof. Charge control additives are present in the toner particles in any desired or effective amounts, typically at least about 0.1 percent by weight of the toner particles, and typically no more than about 5 percent by weight of the toner particles, although the amount can be outside of this range.

Examples of optional surface additives include metal salts, metal salts of fatty acids, colloidal silicas, and the like, as well as mixtures thereof. External additives are present in any desired or effective amount, typically at least about 0.1 percent by weight of the toner particles, and typically no more than about 2 percent by weight of the toner particles, although the amount can be outside of this range, as disclosed in, for example, U.S. Pat. Nos. 3,590,000, 3,720,617, 3,655,374 and 3,983,045, the disclosures of each of which are totally incorporated herein by reference. Preferred additives include zinc stearate and AEROSIL R812® silica, available from Degussa. The external additives can be added during the aggregation process or blended onto the formed particles.

The toner particles of the present invention are prepared by an emulsion aggregation process. This process entails (1) preparing a colorant (such as a pigment) dispersion in a solvent (such as water), which dispersion comprises a colorant, an ionic surfactant, and an optional charge control agent, (2) shearing the colorant dispersion with a latex mixture comprising (a) a counterionic surfactant with a charge polarity of opposite sign to that of said ionic surfactant, (b) a nonionic surfactant, and (c) a resin, thereby causing flocculation or heterocoagulation of formed particles of colorant, resin, and optional charge control agent to form electrostatically bound aggregates, and (3) heating the electrostatically bound aggregates to form stable aggregates of at least about 1 micron in average particle diameter. Toner particle size is typically at least about 1 micron and typically no more than about 7 microns, although the particle size can be outside of this range. Heating can be at a temperature typically of from about 5 to about 50° C. above the resin glass transition temperature, although the temperature can be outside of this range, to coalesce the electrostatically bound aggregates, thereby forming toner particles comprising resin, colorant, and optional charge control agent. Alternatively, heating can be first to a temperature below the resin glass transition temperature to form electrostatically bound micron-sized aggregates with a narrow particle size distribution, followed by heating to a temperature above the resin glass transition temperature to provide coalesced micron-sized marking toner particles comprising resin, pigment, and optional charge control agent. The coalesced particles differ from the uncoalesced aggregates primarily in morphology; the uncoalesced particles have greater surface area, typically having a "grape cluster" shape, whereas the coalesced particles are reduced in surface area, typically having a "potato" shape or even a spherical shape. The particle morphology can be controlled by adjusting conditions during the coalescence process, such as pH, temperature, coalescence time, and the like. Optionally, an additional amount of an ionic surfactant (of the same polarity as that of the initial latex) or nonionic surfactant can be added to the mixture prior to heating to minimize subsequent further growth or enlargement of the particles, followed by heating and coalescing the mixture. Subsequently, the toner particles are washed extensively to remove excess water soluble surfactant or surface absorbed surfactant, and are then dried to produce colored polymeric toner particles. An alternative process entails using a flocculating or coagulating agent such as poly(aluminum chloride) instead of a counterionic surfactant of opposite polarity to the ionic surfactant in the latex formation; in this process, the growth of the aggregates can be slowed or halted by adjusting the solution to a more basic pH (typically at least about 7 or 8, although the pH can be outside of this range), and, during the coalescence step, the solution can, if desired, be adjusted to a more acidic pH to adjust the particle morphology. The coagulating agent typically is added in an acidic solution (for example, a 1 molar nitric acid solution) to the mixture of ionic latex and dispersed pigment, and during this addition step the viscosity of the mixture increases. Thereafter, heat and stirring are applied to induce aggregation and formation of micron-sized particles. When the desired particle size is achieved, this size can be frozen by increasing the pH of the mixture, typically to from about 7 to about 8, although the pH can be outside of this range, Thereafter, the temperature of the mixture can be increased to the desired coalescence temperature, typically from about 80 to about 95° C., although the temperature can be outside of this range. Subsequently, the particle morphology can be adjusted by dropping the pH of the mixture, typically to values of from about 4.5 to about 7, although the pH can be outside of this range.

Examples of suitable ionic surfactants include anionic surfactants, such as sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, DOWFAX®, available from Dow Chemical Co., and the like, as well as mixtures thereof. Anionic surfactants can be employed in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount can be outside of these ranges.

Examples of suitable ionic surfactants also include cationic surfactants, such as dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof. Cationic surfactants can be employed in any desired or effective amounts, typically at least about 0.1 percent by weight of water, and typically no more than about 5 percent by weight of water, although the amount can be outside of this range. Preferably the molar ratio of the cationic surfactant used for flocculation to the anionic surfactant used in latex preparation from about 0.5:1 to about 4:1, and preferably from about 0.5:1 to about 2:1, although the relative amounts can be outside of these ranges.

Examples of suitable nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®), and the like, as well as mixtures thereof. The nonionic surfactant can be present in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount can be outside of these ranges.

The emulsion aggregation process suitable for making the toner materials for the present invention has been disclosed in previous U.S. patents. For example, U.S. Pat. No. 5,290,654 (Sacripante et al.), the disclosure of which is totally incorporated herein by reference, discloses a process for the preparation of toner compositions which comprises dissolving a polymer, and, optionally a pigment, in an organic solvent; dispersing the resulting solution in an aqueous medium containing a surfactant or mixture of surfactants; stirring the mixture with optional heating to remove the organic solvent, thereby obtaining suspended particles of about 0.05 micron to about 2 microns in volume diameter; subsequently homogenizing the resulting suspension with an optional pigment in water and surfactant, followed by aggregating the mixture by heating, thereby providing toner particles with an average particle volume diameter of from between about 3 to about 21 microns when said pigment is present.

U.S. Pat. No. 5,278,020 (Grushkin et al.), the disclosure of which is totally incorporated herein by reference, discloses a toner composition and processes for the preparation thereof comprising the steps of: (i) preparing a latex emulsion by agitating in water a mixture of a nonionic surfactant, an anionic surfactant, a first nonpolar olefinic monomer, a second nonpolar diolefinic monomer, a free radical initiator, and a chain transfer agent; (ii) polymerizing the latex emulsion mixture by heating from ambient temperature to about 80° C. to form nonpolar olefinic emulsion resin particles of volume average diameter from about 5 nanometers to about 500 nanometers; (iii) diluting the nonpolar olefinic emulsion resin particle mixture with water; (iv) adding to the diluted resin particle mixture a colorant or pigment particles and optionally dispersing the resulting mixture with a homogenizer; (v) adding a cationic surfactant to flocculate the colorant or pigment particles to the surface of the emulsion resin particles; (vi) homogenizing the flocculated mixture at high shear to form statically bound aggregated composite particles with a volume average diameter of less than or equal to about 5 microns; (vii) heating the statically bound aggregate composite particles to form nonpolar toner sized particles; (viii) optionally halogenating the nonpolar toner sized particles to form nonpolar toner sized particles having a halopolymer resin outer surface or encapsulating shell; and (ix) isolating the nonpolar toner sized composite particles.

U.S. Pat. No. 5,308,734 (Sacripante et al.), the disclosure of which is totally incorporated herein by reference, discloses a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

U.S. Pat. No. 5,346,797 (Kmiecik-Lawrynowicz et al.), the disclosure of which is totally incorporated herein by reference, discloses a process for the preparation of toner compositions comprising (i) preparing a pigment dispersion in a solvent, which dispersion comprises a pigment, an ionic surfactant, and optionally a charge control agent; (ii) shearing the pigment dispersion with a latex mixture comprising a counterionic surfactant with a charge polarity of opposite sign to that of said ionic surfactant, a nonionic surfactant, and resin particles, thereby causing a flocculation or heterocoagulation of the formed particles of pigment, resin, and charge control agent to form electrostatically bound toner size aggregates; and (iii) heating the statically bound aggregated particles to form said toner composition comprising polymeric resin, pigment and optionally a charge control agent.

U.S. Pat. No. 5,344,738 (Kmiecik-Lawrynowicz et al.), the disclosure of which is totally incorporated herein by reference, discloses a process for the preparation of toner compositions with a volume median particle size of from about 1 to about 25 microns, which process comprises: (i) preparing by emulsion polymerization an anionic charged polymeric latex of submicron particle size, and comprising resin particles and anionic surfactant; (ii) preparing a dispersion in water, which dispersion comprises optional pigment, an effective amount of cationic flocculant surfactant, and optionally a charge control agent; (iii) shearing the dispersion (ii) with the polymeric latex, thereby causing a flocculation or heterocoagulation of the formed particles of optional pigment, resin, and charge control agent to form a high viscosity gel in which solid particles are uniformly dispersed; (iv) stirring the above gel comprising latex particles and oppositely charged dispersion particles for an effective period of time to form electrostatically bound relatively stable toner size aggregates with narrow particle size distribution; and (v) heating the electrostatically bound aggregated particles at a temperature above the resin glass transition temperature, thereby providing the toner composition comprising resin, optional pigment, and optional charge control agent.

U.S. Pat. No. 5,364,729 (Kmiecik-Lawrynowicz et al.), the disclosure of which is totally incorporated herein by reference, discloses a process for the preparation of toner compositions comprising: (i) preparing a pigment dispersion, which dispersion comprises a pigment, an ionic surfactant, and optionally a charge control agent; (ii) shearing said pigment dispersion with a latex or emulsion blend comprising resin, a counterionic surfactant with a charge polarity of opposite sign to that of said ionic surfactant, and a nonionic surfactant; (iii) heating the above sheared blend below about the glass transition temperature (Tg) of the resin, to form electrostatically bound toner size aggregates with a narrow particle size distribution; and (iv) heating said bound aggregates above about the Tg of the resin.

U.S. Pat. No. 5,370,963 (Patel et al.), the disclosure of which is totally incorporated herein by reference, discloses a process for the preparation of toner compositions with controlled particle size comprising: (i) preparing a pigment dispersion in water, which dispersion comprises pigment, an ionic surfactant, and an optional charge control agent; (ii) shearing at high speeds the pigment dispersion with a polymeric latex comprising resin, a counterionic surfactant with a charge polarity of opposite sign to that of said ionic surfactant, and a nonionic surfactant, thereby forming a uniform homogeneous blend dispersion comprising resin, pigment, and optional charge agent; (iii) heating the above sheared homogeneous blend below about the glass transition temperature (Tg) of the resin while continuously stirring to form electrostatically bounded toner size aggregates with a narrow particle size distribution; (iv) heating the statically bound aggregated particles above about the Tg of the resin particles to provide coalesced toner comprising resin, pigment, and optional charge control agent, and subsequently optionally accomplishing (v) and (vi), (v) separating said toner; and (vi) drying said toner.

U.S. Pat. No. 5,403,693 (Patel et al.), the disclosure of which is totally incorporated herein by reference, discloses a process for the preparation of toner compositions with controlled particle size comprising: (i) preparing a pigment dispersion in water, which dispersion comprises a pigment, an ionic surfactant in amounts of from about 0.5 to about 10 percent by weight of water, and an optional charge control agent; (ii) shearing the pigment dispersion with a latex mixture comprising a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45° C. to about 90° C. and preferably from between about 50° C. and about 80° C. the statically bound aggregated particles to form said toner composition comprising resin, pigment, and optional charge control agent.

U.S. Pat. No. 5,418,108 (Kmiecik-Lawrynowicz et al.), the disclosure of which is totally incorporated herein by reference, discloses a process for the preparation of toner compositions with controlled particle size and selected morphology comprising (i) preparing a pigment dispersion in water, which dispersion comprises pigment, ionic surfactant, and optionally a charge control agent; (ii) shearing the pigment dispersion with a polymeric latex comprising resin of submicron size, a counterionic surfactant with a charge polarity of opposite sign to that of said ionic surfactant, and a nonionic surfactant, thereby causing a flocculation or heterocoagulation of the formed particles of pigment, resin, and charge control agent, and generating a uniform blend dispersion of solids of resin, pigment, and optional charge control agent in the water and surfactants; (iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles; (iv) heating the above formed aggregated particles about above the Tg of the resin to provide coalesced particles of toner; and optionally (v) separating said toner particles from water and surfactants; and (vi) drying said toner particles.

U.S. Pat. No. 5,405,728 (Hopper et al.), the disclosure of which is totally incorporated herein by reference, discloses a process for the preparation of toner compositions comprising (i) preparing a pigment dispersion in water, which dispersion comprises a pigment, an ionic surfactant, and optionally a charge control agent; (ii) shearing the pigment dispersion with a latex containing a controlled solid contents of from about 50 weight percent to about 20 percent of polymer or resin, counterionic surfactant, and nonionic surfactant in water, counterionic surfactant with a charge polarity of opposite sign to that of said ionic surfactant, thereby causing a flocculation or heterocoagulation of the formed particles of pigment, resin, and charge control agent to form a dispersion of solids of from about 30 weight percent to 2 percent comprising resin, pigment, and optionally charge control agent in the mixture of nonionic, anionic, and cationic surfactants; (iii) heating the above sheared blend at a temperature of from about 5° to about 25° C. about below the glass transition temperature (Tg) of the resin while continuously stirring to form toner sized aggregates with a narrow size dispersity; and (iv) heating the electrostatically bound aggregated particles at a temperature of from about 5° to about 50° C. about above the (Tg) of the resin to provide a toner composition comprising resin, pigment, and optionally a charge control agent.

U.S. Pat. No. 5,348,832 (Sacripante et al.), the disclosure of which is totally incorporated herein by reference, discloses a toner composition comprising pigment and a sulfonated polyester of the formula or as essentially represented by the formula

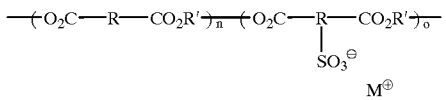

wherein M is an ion independently selected from the group consisting of hydrogen, ammonium, an alkali metal ion, an alkaline earth metal ion, and a metal ion; R is independently selected from the group consisting of aryl and alkyl; R' is independently selected from the group consisting of alkyl and oxyalkylene, and n and o represent random segments; and wherein the sum of n and o are equal to 100 mole percent. The toner is prepared by an in situ process which comprises the dispersion of a sulfonated polyester of the formula or as essentially represented by the formula

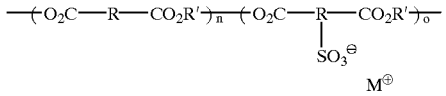

wherein M is an ion independently selected from the group consisting of hydrogen, ammonium, an alkali metal ion, an alkaline earth metal ion, and a metal ion; R is independently selected from the group consisting of aryl and alkyl; R' is independently selected from the group consisting of alkyl and oxyalkylene, and n and o represent random segments; and wherein the sum of n and o are equal to 100 mole percent, in a vessel containing an aqueous medium of an anionic surfactant and a nonionic surfactant at a temperature of from about 100° C. to about 180° C., thereby obtaining suspended particles of about 0.05 micron to about 2 microns in volume average diameter, subsequently homogenizing the resulting suspension at ambient temperature; followed by aggregating the mixture by adding thereto a mixture of cationic surfactant and pigment particles to effect aggregation of said pigment and sulfonated polyester particles; followed by heating the pigment-sulfonated polyester particle aggregates above the glass transition temperature of the sulfonated polyester causing coalescence of the aggregated particles to provide toner particles with an average particle volume diameter of from between 3 to 21 microns.

U.S. Pat. No. 5,366,841 (Patel et al.), the disclosure of which is totally incorporated herein by reference, discloses a process for the preparation of toner compositions comprising: (i) preparing a pigment dispersion in water, which dispersion comprises a pigment, an ionic surfactant, and optionally a charge control agent; (ii) shearing the pigment dispersion with a latex blend comprising resin particles, a counterionic surfactant with a charge polarity of opposite sign to that of said ionic surfactant, and a nonionic surfactant, thereby causing a flocculation or heterocoagulation of the formed particles of pigment, resin, and charge control agent to form a uniform dispersion of solids in the water, and surfactant; (iii) heating the above sheared blend at a critical temperature region about equal to or above the glass transition temperature (Tg) of the resin, while continuously stirring, to form electrostatically bounded toner size aggregates with a narrow particle size distribution and wherein said critical temperature is from about 0° C. to about 10° C. above the resin Tg, and wherein the resin Tg is from about 30° C. to about 65° C. and preferably in the range of from about 45° C. to about 65° C.; (iv) heating the statically bound aggregated particles from about 10° C. to about 45° C. above the Tg of the resin particles to provide a toner composition comprising polymeric resin, pigment, and optionally a charge control agent; and (v) optionally separating and drying said toner.

U.S. Pat. No. 5,501,935 (Patel et al.), the disclosure of which is totally incorporated herein by reference, discloses a process for the preparation of toner compositions consisting essentially of (i) preparing a pigment dispersion, which dispersion comprises a pigment, an ionic surfactant, and optionally a charge control agent; (ii) shearing said pigment dispersion with a latex or emulsion blend comprising resin, a counterionic surfactant with a charge polarity of opposite sign to that of said ionic surfactant, and a nonionic surfactant; (iii) heating the above sheared blend below about the glass transition temperature (Tg) of the resin to form electrostatically bound toner size aggregates with a narrow particle size distribution; (iv) subsequently adding further anionic or nonionic surfactant solution to minimize further growth in the coalescence (v); and (v) heating said bound aggregates above about the Tg of the resin and wherein said heating is from a temperature of about 103° to about 120° C., and wherein said toner compositions are spherical in shape.

U.S. Pat. No. 5,496,676 (Croucher et al.), the disclosure of which is totally incorporated herein by reference, discloses a process comprising: (i) preparing a pigment dispersion comprising pigment, ionic surfactant, and optional charge control agent; (ii) mixing at least two resins in the form of latexes, each latex comprising a resin, ionic and nonionic surfactants, and optionally a charge control agent, and wherein the ionic surfactant has a countercharge to the ionic surfactant of (i) to obtain a latex blend; (iii) shearing said pigment dispersion with the latex blend of (ii) comprising resins, counterionic surfactant with a charge polarity of opposite sign to that of said ionic surfactant, and a nonionic surfactant; (iv) heating the above sheared blends of (iii) below about the glass transition temperature (Tg) of the resin, to form electrostatically bound toner size aggregates with a narrow particle size distribution; and (v) subsequently adding further anionic surfactant solution to minimize further growth of the bound aggregates (vi); (vi) heating said bound aggregates above about the glass transition temperature Tg of the resin to form stable toner particles; and optionally (vii) separating and drying the toner.

U.S. Pat. No. 5,527,658 (Hopper et al.), the disclosure of which is totally incorporated herein by reference, discloses a process for the preparation of toner comprising: (i) preparing a pigment dispersion comprising pigment, an ionic surfactant, and optionally a charge control agent; (ii) shearing said pigment dispersion with a latex comprising resin, a counterionic surfactant with a charge polarity of opposite sign to that of said ionic surfactant, and a nonionic surfactant; (iii) heating the above sheared blend of (ii) about below the glass transition temperature (Tg) of the resin, to form electrostatically bound toner size aggregates with a volume average diameter of from between about 2 and about 15 microns and with a narrow particle size distribution as reflected in the particle diameter GSD of between about 1.15 and about 1.30, followed by the addition of a water insoluble transition metal containing powder ionic surfactant in an amount of from between about 0.05 and about 5 weight percent based on the weight of the aggregates; and (iv) heating said bound aggregates about above the Tg of the resin to form toner.

U.S. Pat. No. 5,585,215 (Ong et al.), the disclosure of which is totally incorporated herein by reference, discloses a toner comprising color pigment and an addition polymer resin, wherein said resin is generated by emulsion polymerization of from 70 to 85 weight percent of styrene, from about 5 to about 20 weight percent of isoprene, from about 1 to about 15 weight percent of acrylate, or from about 1 to about 15 weight percent of methacrylate, and from about 0.5 to about 5 weight percent of acrylic acid.

U.S. Pat. No. 5,650,255 (Ng et al.), the disclosure of which is totally incorporated herein by reference, discloses an in situ chemical process for the preparation of toner comprising (i) the provision of a latex, which latex comprises polymeric resin particles, an ionic surfactant, and a nonionic surfactant; (ii) providing a pigment dispersion, which dispersion comprises a pigment solution, a counterionic surfactant with a charge polarity of opposite sign to that of said ionic surfactant, and optionally a charge control agent; (iii) mixing said pigment dispersion with said latex with a stirrer equipped with an impeller, stirring at speeds of from about 100 to about 900 rpm for a period of from about 10 minutes to about 150 minutes; (iv) heating the above resulting blend of latex and pigment mixture to a temperature below about the glass transition temperature (Tg) of the resin to form electrostatically bound toner size aggregates; (v) adding further aqueous ionic surfactant or stabilizer in the range amount of from about 0.1 percent to 5 percent by weight of reactants to stabilize the above electrostatically bound toner size aggregates; (vi) heating said electrostatically bound toner sized aggregates above about the Tg of the resin to form toner size particles containing pigment, resin and optionally a charge control agent; (vii) optionally isolating said toner, optionally washing with water; and optionally (viii) drying said toner.

U.S. Pat. No. 5,650,256 (Veregin et al.), the disclosure of which is totally incorporated herein by reference, discloses a process for the preparation of toner comprising: (i) preparing a pigment dispersion, which dispersion comprises a pigment and an ionic surfactant; (ii) shearing said pigment dispersion with a latex or emulsion blend comprising resin, a counterionic surfactant with a charge polarity of opposite sign to that of said ionic surfactant, and a nonionic surfactant, and wherein said resin contains an acid functionality; (iii) heating the above sheared blend below about the glass transition temperature (Tg) of the resin to form electrostatically bound toner size aggregates; (iv) adding anionic surfactant to stabilize the aggregates obtained in (iii); (v) coalescing said aggregates by heating said bound aggregates above about the Tg of the resin; (vi) reacting said resin of (v) with acid functionality with a base to form an acrylic acid salt, and which salt is ion exchanged in water with a base or a salt, optionally in the presence of metal oxide particles, to control the toner triboelectrical charge, which toner comprises resin and pigment; and (vii) optionally drying the toner obtained.

U.S. Pat. No. 5,376,172 (Tripp et al.), the disclosure of which is totally incorporated herein by reference, discloses a process for preparing silane metal oxides comprising reacting a metal oxide with an amine compound to form an amine metal oxide intermediate, and subsequently reacting said intermediate with a halosilane. Also disclosed are toner compositions for electrostatic imaging processes containing the silane metal oxides thus prepared as charge enhancing additives.

Copending application U.S. Ser. No. 09/173,405, filed Oct. 15, 1998, entitled "Toner Coagulant Processes," with the named inventors Raj D. Patel, Michael A. Hopper, and Richard P. Veregin, the disclosure of which is totally incorporated herein by reference, discloses a process for the preparation of toner which comprises mixing a colorant, a latex, and two coagulants, followed by aggregation and coalescence. In one embodiment, the first coagulant is a polyaluminum hydroxy halide and the second coagulant is a cationic surfactant.

In a particularly preferred embodiment of the present invention (with example amounts provided to indicate relative ratios of materials), the emulsion aggregation process entails diluting with water (2,000 parts by weight) an aqueous pigment dispersion solution (30.4 parts by weight) containing 53 percent by weight solids of Pigment (Blue Cyan 15:3) dispersed into an anionic surfactant solution and stirred at low shear of 400 revolutions per minute using a homogenizer. Slowly 1,040 parts by weight of an emulsion latex (37.25 percent by weight solids; prepared by emulsion polymerization of styrene, n-butyl acrylate, and acrylic acid monomers initiated with ammonium persulphate and stabilized with Hydrosurf surfactant) is added. The ratio of monomers is about 82 percent by weight styrene and about 18 percent by weight n-butyl acrylate. For every 100 parts by weight of monomer, 2 parts by weight of acrylic acid is added to the monomer mixture. To this well stirred (4,000 to 5,000 revolutions per minute) pigmented latex dispersion is added 7.5 parts by weight of a cationic surfactant (such as Sanizol B, available from Kao Chemical), and as the cationic surfactant is added the solution viscosity generally increases. The mixture is transferred into a 2 liter glass reaction kettle equipped with an overhead stirrer, temperature probe, and water-jacketed heating mantle to control the reaction temperature. The particles are heated at about 1° C. per minute up to 50° C. to produce the desired particle size and size distribution, The particle size and size distribution are then frozen by adding 200 parts by weight of a surfactant solution containing 20 percent by weight anionic surfactant (such as Neogen R, available from Kao Chemical). The particles are coalesced by heating at 95° C. for 3 hours. After cooling, the particle suspension is adjusted to pH about 10 or 11 with potassium hydroxide solution, followed by washing of the particles by filtration. The particles are washed twice more by adding water to the filtered particles and adjusting the pH to about 10 or 11, stirring for about 0.5 to 1 hour, and vacuum filtering through a 1.2 micron porous filter paper. After these two washing steps are completed, three or more additional washing steps are carried out by a similar process except that the pH of the water added to the filtered particles is not adjusted. The particles are subsequently freeze dried for 48 hours to produce dry marking particles.

Subsequent to formation, the dry toner particles are mixed with hydrophobic conductive metal oxide particles. Mixing can be done by any suitable dry mixing process; one preferred mixing process provides high shear by the use of an impeller blade. Examples of dry mixing processes are for example by roll mill, media mill, paint shaker, Henschel blender, and the like. In the preferred method, the impeller blade of the mixer rotates at a speed typically of from about 100 to about 15,000 rpm, and preferably from about 300 to about 10,000 rpm, and the impeller blade rotates at a speed typically of from about 0.5 to about 20 meters per second, and preferably from about 1 to about 10 meters per second, although the impeller blade speed can be outside of these ranges.

The conductive metal oxide can be a conductive titanium dioxide ($TiO_2$), including a metatitanic acid type and also those in the anatase, rutile, or amorphous forms. Other suitable conductive metal oxides include doped conductive tin oxides ($SnO_2$), such as Tego Conduct Ultra and Tego Conduct S, available from Goldshmidt Industrial Chemical Corporation, and SN-100P from Ishihara Sangyo Kaisha, LTD, Japan. Also suitable are antimony-doped tin oxides, such as EC-100, EC-210, EC-300, and EC-650. Also suitable are aluminum oxide ($Al_2O_3$) incorporating silicon dioxide ($SiO_2$), such as ST-490C, and silicon dioxide treated with, for example, n-butyl trimethoxysilane (STT-30A), all available from Titan Kogyo Kabushiki Kaisha, Tokio-Japan (IK Inabata America Corporation, New York). In one specific embodiment, the conductive metal oxide is a mixture of conductive titanium dioxide with a second metal oxide, typically in relative amounts of from about 5 to about 70 percent by weight of the second metal oxide and from about 30 to about 95 percent by weight of the first metal oxide, and preferably in relative amounts of from about 10 to about 50 percent by weight of the second metal oxide and from about 50 to about 90 percent by weight of the first metal oxide, although the relative amounts can be outside of these ranges. Examples of suitable second metal oxides include, but are not limited to, silicon dioxide ($SiO_2$), alumina ($Al_2O_3$), zinc oxide ($ZnO_2$), antimony oxide ($Sb_2O_3$), and the like.

The conductive metal oxide particles are surface treated to render them hydrophobic. The hydrophobic surface treatment can be made by any desired or suitable method, such as with a silane coupling agent, a silicone oil, an aliphatic acid, a titanate or zirconate coupling agent, or the like, as well as mixtures thereof. Examples of suitable silane coupling agents include (but are not limited to) $CF_3(CF_2)_6(CH_2)_2SiCl_3$; $CF_3(CF_2)_6CH_2O(CH_2)_3SiCl_3$; $(CF_3)_2CFO(CH_2)SiCl_3$; $CF_3CH_2CH_2Si(OCH_3)_3$; $CH_3SiCl_3$; $CH_3CH_2CH_2CH_2Si(OCH_3)_3$; $(CH_3)_2CHSi(OCH_3)_3$; $(CH_3)_2SiCl_2$; $(CH_3)_3SiCl$; $CH_3SiBr_3$; $CH_3SiF_3$; $CH_3SiI_3$; $C_2H_5SiCl_3$; $CH_2{=}CHSiCl_3$; $CH_2{=}C(CH_3)COO(CH_2)_3SiCl_3$; $CH_3C_6H_4SiCl_3$; $BrCH_2C_6H_4SiCl_3$; epoxy O—$CH_2$—CH—$CH_2O(CH_2)_3SiCl_3$; $C_6H_5SiCl_3$; $Cl(CH_2)_3SiCl_3$, $BrC_6H_4SiCl_3$; and the like, as disclosed in Silane Coupling Agents, by Edwin P. Plueddemann, 2nd Ed., Plenum Press, 1991, ISBN 0-306-43473-3, the disclosure of which is totally incorporated herein by reference. A number of other preferred organosilane coupling or linking agents are disclosed in *Silicon Compounds, Register and Review*, published by Petrarch Systems, Bristol, Pa. (1982), the disclosure of which is totally incorporated herein by reference, such as trialkylsilylchlorides and dialkylsilyldichorides. A preferred class of coupling agents, of the formula $SiX_nR_{4-n}$, is that of alkyl trihalosilanes, $SiX_3R$ wherein X is a leaving or departing group such as halogen or alkoxy (wherein alkoxy typically has from about 1 to about 5 carbon atoms), R is alkyl, alkenyl, alkynyl, aryl, alkaryl, aralkyl, or halogenated derivatives thereof, typically with from 1 to about 25 carbon atoms, although the number of carbon atoms can be outside of this range, and n is an integer having a value of from 1 to 3. Examples of suitable silicone oils include, but are not limited to, dimethylsilicone, methylphenylsilicone, monomethylsilicone, and modified silicone oils. Specific examples include methyl silicone oils KS-96 and KS-2 and amino modified oils X-22-162A, all commercially available from Shin-Etsu Kagaku Kogyo Co., Ltd., and fluorine modified silicone oil FS1265, commercially available from Toray Dau-Koningu Silicone Co., Ltd. Examples of suitable titanate and zirconate coupling agents include Ken-React KR TTS, a monoalkoxy titanate coupling agent, Ken-React LICA, a neoalkoxy titanate liquid coupling agent, and Ken-React NZ, a neoalkoxy zirconate liquid coupling agent, all from Kenrich Petrochemicals, Inc. Examples of suitable aliphatic acids include (but are not limited to) those of the general formula $CH_3(CH_2)_nCOOH$, wherein n is an integer representing the number of repeat —$CH_2$— units, typically being from about 8 to about 18, although the value of n can be outside of this range.

Examples of suitable commercially available conductive titanium dioxide particles surface treated to render them hydrophobic include (but are not limited to) STT-30A, STT-30A-I, STT-A11-I, STT100H, STT-100HF10, and STT-100HF20, all hydrophobic conductive titanium dioxides available from Titan Kogyo Kabushiki Kaisha, Tokio-Japan (IK Inabata America Corporation, New York).

The conductive metal oxide particles can also be treated with the materials and by the methods disclosed in, for example, U.S. Pat. Nos. 5,376,172, 5,484,675, and Copending application U.S. Ser. No. 09/408,606, the disclosures of each of which are totally incorporated herein by reference, The hydrophobic conductive metal oxide particles typically have an average primary particle diameter of at least about 7 nanometers, preferably at least about 12 nanometers, more preferably at least about 20 nanometers, and even more preferably at least about 30 nanometers, and typically have an average primary particle diameter of no more than about 300 nanometers, preferably no more than about 100 nanometers, more preferably no more than about 60 nanometers, and even more preferably no more than about 50 nanometers, although the average primary particle diameter can be outside of these ranges. (The term "average primary particle diameter" is used herein to refer to individual primary metal oxide particles, which are to be distinguished from particle aggregates, which can occur when two or more primary particles aggregate, and from particle agglomerates, which can occur when two or more aggregates agglomerate. Primary particle size can be distinguished by, for example, scanning electron microscopy.)

The hydrophobic conductive metal oxide particles typically have an average bulk conductivity of greater than or equal to about $10^{-11}$ Siemens per centimeter, preferably of greater than or equal to about $10^{-8}$ Siemens per centimeter, and even more preferably of greater than or equal to about $10^{-7}$ Siemens per centimeter, although the average bulk conductivity can be outside of these ranges. There is no upper limit on conductivity. "Average bulk conductivity" refers to the ability for electrical charge to pass through a pellet of the metal oxide particles having a surface coating of hydrophobic material, measured when the pellet is placed between two electrodes.

The hydrophobic conductive metal oxide particles are blended with the toner particles in any desired or effective amount, typically at least about 0.1 part by weight per 100 parts by weight toner particles, preferably at least about 0.5 part by weight per 100 parts by weight toner particles, and more preferably at least about 1 part by weight per 100 parts by weight toner particles, and typically no more than about 15 parts by weight per 100 parts by weight toner particles, preferably no more than about 10 parts by weight per 100 parts by weight toner particles, and more preferably no more than about 5 parts by weight per 100 parts by weight toner particles, although the relative amounts can be outside of these ranges. The relative amounts of hydrophobic conductive metal oxide particles and toner particles can also be expressed in terms of the surface area coverage of the toner particles by the hydrophobic conductive metal oxide particles. This surface area coverage can be calculated or expressed as a percentage, as follows:

$$\text{Percent Surface Area Coverage} = \text{Weight Percent of Metal Oxide} \div \left[100 \times \frac{2\pi}{\sqrt{3}} \times \frac{\rho_a \cdot r}{\rho_t \cdot R}\right]$$

wherein $\rho_a$ is the density of the metal oxide additive, $\rho_t$ is the density of the toner, r is the average primary particle size of the metal oxide additive particles, and R is the average primary particle size of the toner particles. For the marking materials of the present invention, the surface area coverage typically is at least about 20 percent, and preferably at least about 40 percent, and typically is no more than about 150 percent, and preferably no more than about 100 percent, although the surface area coverage can be outside of these ranges, The marking materials of the present invention, comprising the toner particles and the hydrophobic conductive metal oxide particles on the surfaces thereof, typically exhibit interparticle cohesive forces of no more than about 12 percent, and preferably of no more than about 10 percent, although the interparticle cohesive forces can be outside of this range.

The marking materials of the present invention, comprising the toner particles and the hydrophobic conductive metal oxide particles on the surfaces thereof, typically have an average bulk conductivity of greater than or equal to about $10^{-13}$ Siemens per centimeter, preferably of greater than or equal to about $10^{-10}$ Siemens per centimeter, and even more preferably of greater than or equal to about 10–9 Siemens per centimeter, although the average bulk conductivity can be outside of these ranges. There is no upper limit on conductivity.

In the ballistic aerosol marking apparatus, high velocity gas jets in combination with the venturi convergence/divergence structure of the channels generally enables production of a gas stream of marking particles that exit the channels and remain collimated in a narrow stream well beyond the end of the channel. This collimation of the gas stream is not expected beyond the exit point for a straight tube unless the gas velocity is low. Fluid modeling also predicts that small diameter particles in a gas stream travelling at high velocity through channels with a venturi structure will remain collimated well beyond the exit point of the channel, and predicts that similar particles travelling through straight capillary tubes under similar conditions will not remain collimated beyond the channel exit point.

Testing with conventional toner particles of the type commonly used in electrostatographic imaging processes produces results similar to those predicted by the model. For example, when a Canon® CLC-500 toner and a Xerox® DocuColor® 70 toner were employed in a ballistic aerosol marking apparatus with straight channels, the particle stream exiting the straight channels spread significantly in both instances. Depending on the inner diameter of the straight channel and the particle velocity, the particle stream was observed to spread up to 15 to 20 times the diameter of the channel.

In contrast, the marking materials of the present invention, when employed in a ballistic aerosol marking apparatus with straight channels under similar conditions, the exiting particle stream remained substantially more collimated than that observed for the conventional toners.

To enable very small images to be generated by the ballistic aerosol direct marking process, specific and demanding requirements are placed on the marking material. Since the channels in the ballistic aerosol marking apparatus are narrow, the marking material particle size preferably is relatively small. In addition, the particle size distribution preferably is relatively narrow; even a small fraction of large particles (for example, particles substantially greater than about 10 microns in diameter when the channel is from about 40 to about 75 microns in inner diameter) in the marking material can clog or block the channels and stop the flow of marking material exiting the channels. Further, to enable the marking material to flow smoothly and evenly through the channels (either straight or of venturi configuration), the flow properties of the marking material particles preferably are superior to those observed with conventional electrostatographic toner particles; the particle-to-particle cohesive forces preferably are low, a result that is difficult to achieve as the particles decrease in size, since with decreasing size the particle-to-particle cohesive forces increase, It can be particularly challenging to achieve good flow of small marking particles, for example those less than about 7 microns in diameter.

Ballistic aerosol marking processes entail the use of air or other gases as the marking material transport medium to move the marking particles, The polymers commonly used to form the toner particles, such as styrene/acrylate copolymers and the like, are frequently insulative materials; for example, styrene/acrylate copolymers typically exhibit conductivity values of from about $10^{-16}$ to less than about $10^{-13}$ Siemens per centimeter. When the toner particles are fluidized in the ballistic aerosol marking apparatus via air flow, the particles can accumulate surface charge, sticking to the walls of the apparatus and forming aggregates of particles as a result of the electrostatic charge that builds up on the particle surfaces. The hydrophobic conductive metal oxide particles blended with the toner particles increase the particle conductivity and enable improved marking particle flow. In addition, the hydrophobic conductive metal oxide particles also allow some degree of surface charge to be formed on the toner particle surfaces, which, as indicated hereinabove, can be desirable for purposes such as metering the marking material.

The marking materials of the present invention can also be employed for the development of electrostatic images in processes such as electrography, electrophotography, ionography, and the like. Another embodiment of the present invention is directed to a process which comprises (a) generating an electrostatic latent image on an imaging member, and (b) developing the latent image by contacting the imaging member with a marking material comprising (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive titanium dioxide particles situated on the toner particles.

Specific embodiments of the invention will now be described in detail. These examples are intended to be illustrative, and the invention is not limited to the materials, conditions, or process parameters set forth in these embodiments, All parts and percentages are by weight unless otherwise indicated.

EXAMPLE I

A polymeric latex was prepared by the emulsion polymerization of styrene/n-butyl acrylate/acrylic acid (monomer weight ratio 82 parts by weight styrene, 18 parts by weight n-butyl acrylate, 2 parts by weight acrylic acid) in a nonionic/anionic surfactant solution (37.25 percent by weight solids) as follows; 17.54 kilograms of styrene, 3.85 kilograms of n-butyl acrylate, 427.8 grams of acrylic acid, 213.9 grams of carbon tetrabromide, and 620.4 grams of dodecanethiol were admixed with 38.92 kilograms of deionized water in which 481.5 grams of sodium dodecyl benzene sulfonate anionic surfactant (Neogen RK; contains 60 percent active component), 256.7 grams of Hydrosurf NX2 nonionic surfactant (obtained from Xerox Corporation), and 213.9 grams of ammonium persulfate polymerization initiator had been dissolved. The emulsion thus formed was then polymerized at 70° C. for 3 hours, followed by heating to 85° C. for an additional 1 hour. The resulting latex contained 62.75 percent by weight water and 37.25 percent by weight solids, which solids comprised particles of a random copolymer of poly(styrene/n-butyl acrylate/acrylic acid), the glass transition temperature of the latex dry sample was 55.2°C., as measured on a DuPont DSC. The latex had a weight average molecular weight of 25,300 and a number average molecular weight of 5,600, as determined with a Waters gel permeation chromatograph. The particle size of the latex as measured on a Disc Centrifuge was 207 nanometers.

1,040 grams of the styrene/n-butyl acrylate/acrylic acid anionic latex thus prepared and 30.4 grams of BHD 6000 pigment dispersion (obtained from Sun Chemical, containing 53 percent by weight solids of pigment blue cyan 15:3) dispersed into sodium dodecyl benzene sulfonate anionic surfactant (Neogen R) solution was blended with 7.5 grams of cationic surfactant Sanizol B-50 (obtained from Kao Chemical) in 2,000 grams of deionized water using a high shear homogenizer at 10,000 revolutions per minute for 2 minutes, producing a flocculation or heterocoagulation of gelled particles consisting of nanometer sized latex particles and pigment. The pigmented latex slurry was heated at a controlled rate of 0.5° C. per minute to 50° C., at which point the average marking particle size was 5.9 microns and the particle size distribution was 1.21. At this stage, 200 milliliters of a 20 percent by weight solution of Neogen R was added to freeze the marking particle size. The mixture was then heated at a controlled rate of 1° C. per minute to 95° C., followed by maintenance of this temperature for 3 hours. After cooling the reaction mixture to room temperature, the pH of the supernatant was adjusted to pH 11 with a 4 percent by weight solution of potassium hydroxide. The particles were then washed and reslurried in deionized water. The particles were washed twice more at pH 11, followed by two washes in deionized water without any pH adjustment. The particles were then dried on a freeze drier for over 48 hours to provide a dry cyan powder. The resulting dried cyan marking particles of poly(styrene/n-butyl acrylate/acrylic acid) had an average volume diameter of 5.95 microns and the particle size distribution was 1.21 as measured by a Coulter Counter.

29.55 grams of the powdered cyan particles thus formed were then dry blended with 0.45 grams (1.5 percent by weight of the cyan particles) of silica particles (Aerosil R-812, obtained from Degussa).

30 grams of the powdered cyan particles thus formed were then dry blended with 1.35 grams (4.5 percent by weight of the cyan particles) of hydrophobic conductive titanium dioxide particles (STT100H, obtained from Titan Kogyo Kabushiki Kaisha (IK Inabata America Corporation, New York)). This process was repeated to produce a second batch of toner particles surface treated with hydrophobic conductive titanium dioxide particles.

The particle flow values of the marking material with no silica particles, the marking material with silica particles, and the marking materials with hydrophobic conductive titanium dioxide particles were measured with a Hosokawa Micron Powder tester by applying a 1 millimeter vibration for 90 seconds to 2 grams of the marking particles on a set of stacked screens. The top screen contained 150 micron openings, the middle screen contained 75 micron openings, and the bottom screen contained 45 micron openings. The percent cohesion is calculated as follows:

$$\% \text{ cohesion}=50 \cdot A+30 \cdot B+11 \cdot C$$

wherein A is the mass of marking material remaining on the 150 micron screen, B is the mass of marking material remaining on the 75 micron screen, and C is the mass of marking material remaining on the 45 micron screen. (The equation applies a weighting factor proportional to screen size.) This test method is further described in, for example, R. Veregin and R. Bartha, Proceedings of IS&T 14th International Congress on Advances in Non-Impact Printing Technologies, pg 358–361, 1998, Toronto, the disclosure of which is totally incorporated herein by reference. For the ballistic aerosol marking materials, the input energy applied to the apparatus of 300 millivolts was decreased to 50 millivolts to increase the sensitivity of the test. The lower the percent cohesion value, the better the toner flowability.

The flowability characteristics of the marking materials thus prepared were evaluated as follows. About 2 grams of the marking material was placed on top of a porous glass frit inside a ballistic aerosol marking (BAM) flow test fixture. The apparatus consisted of a cylindrical hollow column of plexi-glass approximately 8 centimeters tall by 6 centimeters in diameter containing two porous glass frits. The marking material was placed on the lower glass frit, which was approximately 4 centimeters from the bottom. The second glass frit was part of the removable top portion. Gas was ejected through an opening in the bottom of the device, which was evenly distributed through the lower glass frit to create a fluidized bed of toner in the gas stream. In the top portion of the device was an opening into which a narrow inner diameter straight glass capillary was inserted and through which the marking particle stream was ejected. A continuous 5 mV laser was focused on the particle stream and, using an optical camera and monitor, the particle stream was visualized. The inner diameter of the straight glass capillaries can be changed to screen and identify good flowing toners. In this instance, a 47 micron inner diameter straight glass capillary tube of 3 centimeters in length was used. Using dry nitrogen gas, a fluidized bed of the marking material was produced by blowing gas through the lower porous glass frit to fluidize the marking particles. The height of the fluidized bed and the concentration of marking material exiting the glass capillary from the top of the BAM test fixture was controlled by the gas regulator. The stream of marking particles was observed using a laser-scattering visualization system. A qualitative subjective evaluation scale was developed to rate the different flow performance of the various toners tested in the BAM flow cell. Using a 47 micron inner diameter straight glass capillary a rating of 1 indicated that no toner was seen ejecting out of the capillary as observed using the laser-scattering visualization system. A rating of 2 indicated minimal flow. A rating of 3 was indicated that particle flow was observed for 5 to 8 minutes continuously after shaking or tapping the flow cell. A rating of 4 indicated that toner particles were observed flowing out of the capillary continuously for 12 to 19 minutes. A rating of 5 was given to toners that demonstrated excellent continuous particle flow for greater than 20 minutes without the need to tap or shake the flow cell.

Conductivity values of each of the marking materials thus prepared was determined by preparing pellets of each material under 1,000 to 3,000 pounds per square inch and then applying 10 DC volts across the pellet. The value of the current flowing was then recorded, the pellet was removed and its thickness measured, and the bulk conductivity for the pellet was calculated in Siemens per centimeter.

Values for the conductivity (in Siemens per centimeter), Hosokawa percent cohesion, and flow rating for the marking materials thus prepared were as follows:

| Surface Treatment | Conductivity | % Cohesion | Flow Rating |
|---|---|---|---|
| none | $7.9 \times 10^{-14}$ | >60 | 1 |
| 4.5 wt. % titanium dioxide batch A | $1.5 \times 10^{-11}$ | 5.1 | 5 |
| 4.5 wt. % titanium dioxide batch B | $2.4 \times 10^{-11}$ | 5.2 | 5 |

As the data indicate, when the hydrophobic conductive titanium dioxide was blended onto the toner particles, the particle flow was improved, the cohesion was improved with respect to the toner particles with no surface treatment, and the conductivity was substantially improved.

Additional marking materials were prepared with varying amounts of the hydrophobic conductive titanium dioxide particles. Pellets of these marking materials were formed and the conductivity of each was measured. The results were as follows:

| Wt. % titanium dioxide | Conductivity (S/cm) |
|---|---|
| 0 | $9.9 \times 10^{-14}$ |
| 2.5 | $1.3 \times 10^{-12}$ |
| 3 | $7.8 \times 10^{-12}$ |
| 4.5 | $1.5 \times 10^{-11}$ |

As the results indicate, there is a very strong correlation between the amount of the hydrophobic conductive titanium dioxide on the toner particle surface and the conductivity. The conductivity increases about one order of magnitude for a 1 weight percent increase in this specific additive loading. Different relative amounts of hydrophobic conductive titanium dioxide particles may be ideal, depending on the specific hydrophobic conductive titanium dioxide particles selected.

EXAMPLE II

A toner composition was prepared as described in Example I except that: (1) a styrene/n-butyl acrylate/β-carboxy ethyl acrylate latex, with the monomers present in relative amounts of 71 parts by weight/23 parts by weight/6 parts by weight respectively, obtained as Antarox-free EAN 12-37/39K2 from Dow Chemical Co., Midland, Mich. (this latex can also be prepared as described in, for example, Copending application U.S. Ser. No. 09/173,405, the disclosure of which is totally incorporated herein by reference), was substituted for the 82/18/2 styrene/n-butyl acrylate/acrylic acid latex; REGAL® 330 carbon black pigment was substituted for the pigment blue cyan 15:3, said carbon black pigment being present in the toner in an amount of 6 percent by weight; and (3) the toner further contained 8 percent by weight of Polywax® 725 polyethylene wax. The toner particles had a weight average molecular weight of 37,200 and a number average molecular weight of 10,500, with an average particle size (D50) of 5.33 microns (GSDv of 1.214) and a glass transition temperature $T_g$ of 51.1° C. Portions of the toner particles thus prepared were admixed with various different hydrophobic conductive titanium dioxide particles (all obtained from Titan Kogyo Kabushiki Kaisha (IK Inabata America Corporation, New York)) in amounts of 30 grams of toner particles admixed with 1.35 grams of hydrophobic conductive titanium dioxide particles (4.5 percent by weight hydrophobic conductive titanium dioxide particles). The percent cohesion and average bulk conductivity (Siemens per centimeter) were measured as described in Example I. In addition, relative humidity sensitivity was measured by charging a first portion of the particles in a controlled atmosphere at 10° C. and 15 percent relative humidity (referred to as "C" zone), charging a second portion of the particles in a controlled atmosphere at 28° C. and 80 percent relative humidity (referred to as "A" zone), by roll milling 1 gram of toner and 24 grams of carrier on a roll mill at a speed of 90 feet per minute for 30 minutes, measuring the charge over mass (q/m) values for each toner portion, and dividing the q/m value for the C zone by the q/m value for the A zone, as follows:

$$\text{RH Sensitivity} = \frac{\left(\frac{q_C}{m_C}\right)}{\left(\frac{q_A}{m_A}\right)}$$

The results were as follows:

| Additive | $q_A/m_A$ | $q_C/m_C$ | RH Sensitivity | % Cohesion | Conductivity |
|---|---|---|---|---|---|
| STT-100H | −13 | −10.2 | 0.78 | 2.2 | $4.80 \times 10^{-10}$ |
| STT-100HF10 | −15.1 | −23.4 | 1.55 | 3.4 | $1.40 \times 10^{-10}$ |
| STT-100HF20 | −20.6 | −29.2 | 1.42 | 11.7 | $2.00 \times 10^{-10}$ |
| STT-30A | −5.7 | −6.7 | 1.17 | 9.7 | $3.50 \times 10^{-11}$ |
| STT-30A-1 | −8.6 | −11.7 | 1.36 | 10 | $1.70 \times 10^{-11}$ |
| STT-A11-1 | −14.25 | −13.2 | 0.93 | 7.3 | $1.80 \times 10^{-10}$ |

EXAMPLE III

A black toner was prepared as described in Example II. A 30 gram portion of the toner thus prepared was then admixed with one percent by weight of hydrophobic conductive titanium dioxide (STT-100H, obtained from Titan Kogyo Kabushiki Kaisha (IK Inabata America Corporation, New York)). The relative humidity sensitivity of this marking material was measured as described in Example II. The values of both $q_c/m_c$ and $q_A/m_A$ were −30 microcoulombs per gram, resulting in a RH sensitivity value of 1, and indicating that the marking material thus prepared is highly insensitive to widely varying environmental conditions.

A similar toner was prepared by admixing 30 grams of the toner with 4.5 percent by weight (1.35 grams) of the STT-100H hydrophobic conductive titanium dioxide. The RH sensitivity value for this marking material was 0.8, with a flow value of 2.2 percent and a conductivity of $4.8\times10^{-10}$ Siemens per centimeter.

Comparative Example A

A toner composition was prepared as described in Example II and portions thereof were admixed with a more insulating hydrophobic titanium dioxide (STT-30AF10, available from Titan Kogyo, Japan, with a bulk conductivity of $1.2\times10^{-13}$ Siemens per centimeter) to form a first marking material containing 1 part by weight titanium dioxide per 100 parts by weight toner and a second marking material containing 4.5 parts by weight titanium dioxide per 100 parts by weight toner. Relative humidity sensitivity for these two marking materials was measured as described in Example II. The first marking material exhibited an average bulk conductivity of $2.6\times10^{-13}$ and a RH sensitivity of 1.4; the second marking material exhibited an average bulk conductivity of $2.1\times10^{-13}$ and a RH sensitivity of 0.9. The flow cohesion was 60 percent for the first marking material and 49.4 percent for the second marking material. At 4.5 weight percent additive, the cohesion for the second toner was 22 times higher than that obtained with 4.5 weight percent of the STT-100H additive in Example II. The comparison between these materials and those in Example II is summarized in the table below:

| Additive | $q_A/m_A$ | $q_C/m_C$ | RH Sensitivity | % Cohesion | Conductivity |
|---|---|---|---|---|---|
| 1% STT-100H | −30 | −30.5 | 1 | 25 | $1.3 \times 10^{-11}$ |
| 4.5% STT-100H | −13 | −10.2 | 0.78 | 2.2 | $4.8 \times 10^{-10}$ |
| 1% STT-30AFS10 | −35.4 | −51 | 1.4 | 60.1 | $2.6 \times 10^{-13}$ |
| 4.5% STT-30AFS10 | −36 | −32.5 | 0.9 | 49.4 | $3.8 \times 10^{-13}$ |

Other embodiments and modifications of the present invention may occur to those of ordinary skill in the art subsequent to a review of the information presented herein, these embodiments and modifications, as well as equivalents thereof, are also included within the scope of this invention.

What is claimed is:

1. A process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles.

2. A process according to claim 1 wherein The metal oxide comprises (a) titanium dioxide; (b) mixtures of titanium dioxide with (i) silicon dioxide, (ii) alumina, (iii) zinc oxide, (iv) antimony oxide, or (v) mixtures thereof; (c) tin oxide; (d) antimony-doped tin oxide; (e) mixtures of aluminum oxide and silicon dioxide; (f) silicon dioxide treated wiTh n-buiyl trimethoxysilane; or (g) mixtures thereof.

3. A process according to claim 1 wherein the metal oxide comprises titanium dioxide.

4. A process according to claim 1 wherein the hydrophobic conductive metal oxide is a conductive metal oxide surface treated with a hydrophobic material which is a silane coupling agent, a silicone oil, an aliphatic acid, a titanate or zirconate coupling agent, or mixtures thereof.

5. A process according to claim 1 wherein the hydrophobic conductive metal oxide is a conductive metal oxide surface treated with $CF_3(CF_2)_6(CH_2)_2SiCl_3$; $CF_3$ $(CF_2)_6$ $CH_2O(CH_2)_3SiCl_3$; $(CF_3)_2CFO(CH_2)SiCl_3$; $CF_3CH_2CH_2Si(OCH_3)_3$; $CH_3SiCl_3$; $CH_3CH_2CH_2CH_2Si(OCH_3)_3$; $(CH_3)_2CHSi(OCH_3)_3$; $(CH_3)_2SiCl_2$; $(CH_3)_3SiCl$; $CH_3SiBr_3$; $CH_3SiF_3$; $CH_3SiI_3$; $C_2H_5SiCl_3$; $CH_2{=}CHSiCl_3$; $CH_2{=}C(CH_3)COO(CH_2)_3SiCl_3$; $CH_3C_6H_4SiCl_3$; $BrCH_2C_6H_4SiCl_3$; epoxy O—$CH_2$—CH—$CH_2O(CH_2)_3SiCl_3$; $C_6H_5SiCl_3$; $Cl(CH_2)_3SiCl_3$; $BrC_6H_4SiCl_3$; epoxy O—$CH_2$—CH—$CH_2O(CH_2)_3SiCl_3$; $C_6H_5SiCl_3$; $Cl(CH_2)_3SiCl_3$; $BrC_6H_4SiCl_3$; dimethylsilicone; methylphenylsilicone; monomethylsilicone; amino modified silicone oils; fluorine modified silicone oils; monoalkoxy titanate coupling agents; neoalkoxy titanate liquid coupling agents; neoalkoxy zirconate liquid coupling agents; acids of the formula $CH_3(CH_2)_nCOOH$ wherein n is an integer representing the number of repeat —$CH_2$— units; or mixtures thereof.

6. A process according to claim 1 wherein the hydrophobic conductive metal oxide has an average primary particle diameter of at least about 7 nanometers and wherein the hydrophobic conductive metal oxide has an average primary particle diameter of no more than about 300 nanometers.

7. A process according to claim 1 wherein the hydrophobic conductive metal oxide has an average bulk conductivity of greater than or equal to about $10^{-11}$ Siemens per centimeter.

8. A process according to claim 1 wherein the toner particles and the hydrophobic conductive metal oxide particles are present in relative amounts of at least about 0.1 part by weight hydrophobic conductive metal oxide particles per 100 parts by weight toner particles, and wherein the toner particles and the hydrophobic conductive metal oxide particles are present in relative amounts of no more than about 15 parts by weight hydrophobic conductive metal oxide particles per 100 parts by weight toner particles.

9. A process according to claim 1 wherein the hydrophobic conductive metal oxide particles cover the toner particles with a surface area coverage of at least about 20 percent and wherein the hydrophobic conductive metal oxide particles cover the toner particles with a surface area coverage of no more than about 150 percent.

10. A process according to claim 1 wherein the particulate marking material exhibits interparticle cohesive forces of no more than about 12 percent.

11. A process according to claim 1 wherein the particulate marking material has an average bulk conductivity of greater than or equal to about $10^{-13}$ Siemens per centimeter.

12. A process according to claim 1 wherein the colorant is a pigment.

13. A process according to claim 1 wherein the resin is selected from poly(styrene/butadiene), poly(p-methyl styrene/butadiene), poly(m-methyl styrene/butadiene), poly(α-methyl styrene/butadiene), poly(methyl methacrylate/butadiene), poly(ethyl methacrylate/butadiene), poly(propyl methacrylate/butadiene), poly(butyl methacrylate/butadiene), poly(methyl acrylate/butadiene), poly(ethyl acrylate/butadiene), poly(propyl acrylate/butadiene), poly(butyl acrylate/butadiene), poly(styrene/isoprene), poly(p-methyl styrene/isoprene), poly(m-methyl styrene/isoprene), poly(α-methyl styrene/isoprene), poly(methyl methacrylate/isoprene), poly(ethyl methacrylate/isoprene), poly(propyl methacrylate/isoprene), poly(butyl methacrylate/isoprene), poly(methyl acrylate/isoprene), poly(ethyl acrylate/isoprene), poly(propyl acrylate/isoprene), poly(butylacrylate-isoprene), poly(styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), polyethylene terephthalate, polypropylene terephthalate, polybutylene terephthalate, polypentylene terephthalate, polyhexalene terephthalate, polyheptadene terephthalate, polyoctalene-terephthalate, sulfonated polyesters, and mixtures thereof.

14. A process according to claim 1 wherein the resin is poly(styrene/n-butyl acrylate/acrylic acid), poly(styrene/n-butyl methacrylate/acrylic acid), poly(styrene/n-butyl acrylate/β-carboxyethyl acrylate), or poly(styrene/n-butyl methacrylate/β-carboxyethyl acrylate).

15. A process according to claim 1 wherein the emulsion aggregation process comprises (1) preparing a colorant dispersion in a solvent, which dispersion comprises a colorant and a first ionic surfactant; (2) shearing the colorant dispersion with a latex mixture comprising (a) a counterionic surfactant with a charge polarity of opposite sign to that of said first ionic surfactant, (b) a nonionic surfactant, and (c) a resin, thereby causing flocculation or heterocoagulation of formed particles of colorant and resin to form electrostatically bound aggregates; and (3) heating the electrostatically bound aggregates to form aggregates of at least about 1 micron in average particle diameter.

16. A process according to claim 1 wherein the marking particles have an average particle diameter of no more than about 6.5 microns.

17. A process according to claim 1 wherein the marking particles have a particle size distribution of GSD equal to no more than about 1.23.

18. A process according to claim 1 wherein each said channel has a converging region and a diverging region, and wherein said propellant is introduced in said converging region and flows into said diverging region, whereby said propellant is at a first velocity and first pressure in said converging region and a second velocity and a second pressure in said diverging region, said first pressure greater than said second pressure and said first velocity less than said second velocity.

* * * * *